US008746858B2

(12) United States Patent
Takeuchi et al.

(10) Patent No.: US 8,746,858 B2
(45) Date of Patent: Jun. 10, 2014

(54) RECORDING APPARATUS

(71) Applicant: Seiko Epson Corporation, Tokyo (JP)

(72) Inventors: Hiroshi Takeuchi, Matsumoto (JP); Hiroyuki Yoda, Shiojiri (JP); Kenji Oshima, Minowa-machi (JP); Yoshisada Aoki, Azumino (JP); Satoshi Shimizu, Shiojiri (JP); Kazutoshi Sakamoto, Shiojiri (JP); Nobuhisa Nomoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/850,101

(22) Filed: Mar. 25, 2013

(65) Prior Publication Data

US 2013/0293639 A1 Nov. 7, 2013

(30) Foreign Application Priority Data

Mar. 28, 2012 (JP) ..... 2012-074291

(51) Int. Cl.
*B41J 2/175* (2006.01)

(52) U.S. Cl.
USPC ..... 347/85

(58) Field of Classification Search
USPC ..... 347/7, 84, 85, 101, 104
See application file for complete search history.

(56) References Cited

U.S. PATENT DOCUMENTS

| | | | | |
|---|---|---|---|---|
| 7,407,243 | B2 * | 8/2008 | Sadano | 347/7 |
| 7,500,618 | B2 * | 3/2009 | Fujishiro et al. | 239/91 |
| 7,753,500 | B2 * | 7/2010 | Nishida | 347/84 |
| 8,007,064 | B2 * | 8/2011 | Tsuchiya | 347/7 |

FOREIGN PATENT DOCUMENTS

| | | |
|---|---|---|
| CN | 2825289 | 10/2006 |
| TW | 538909 | 6/2003 |

* cited by examiner

*Primary Examiner* — Anh T. N. Vo
(74) *Attorney, Agent, or Firm* — Workman Nydegger

(57) ABSTRACT

A recording apparatus includes a paper supply tray 31 that is provided on an upstream side of a transport direction in which recording paper P is transported, and which can feed the recording paper P from a first aperture portion 21 provided in a housing 20, a guide member 33, which is provided in the paper supply tray 31 wall surface portion 21*a* of the housing 20, and an ink tube 50 that passes through gap sections S1 and S2 between the guide member 33 and the wall surface portion and supplies ink from an ink accommodation portion 60 which is provided outside the housing 20 to a recording head 43 that is attached to a carriage 41.

28 Claims, 20 Drawing Sheets

RECORDING APPARATUS

TECHNICAL FIELD

The present invention relates to a recording apparatus.

BACKGROUND ART

As shown in PTL 1 and PTL 2 for example, among recording apparatuses, there are recording apparatuses that supply ink to a recording head that a recording apparatus is provided with using an external tank that stores ink. In this kind of recording apparatus, the external tank is provided outside a housing of the recording apparatus, and it is possible to supply ink from the external tank to the ink head that is inside the housing through an ink tube.

CITATION LIST

Patent Literature

[PTL 1] Chinese Examined Utility Model Registration Application Publication No. CN2825289Y

[PTL 2] Chinese Examined Patent Application Publication No. 538909

SUMMARY OF INVENTION

Technical Problem

In the configurations of the disclosures of PTL 1 and PTL 2, in a case in which the ink tube runs from a carriage to the external tank, there is a section which extends toward either the upper side of the carriage or the front side of the carriage. Therefore, in a case in which recording paper becomes stuck in the transport path or the like and it is necessary to remove the recording paper, a user must put their hand into the transport path while avoiding the ink tube. Therefore, in the configurations shown in PTL 1 and PTL 2, the ink tube is an obstruction when removing recording paper.

Accordingly, on the basis of the abovementioned information, an object of the present invention is to provide a recording apparatus that is capable of favorably performing the removal of a recording medium.

Solution to Problem

In order to solve the abovementioned problem, a recording apparatus of the present invention is equipped with a paper supply tray that is provided on an upstream side of a transport direction in which a recording medium is transported, and which can feed the recording medium from a first aperture portion provided in a housing, a guide member, which is provided in the paper supply tray and defines a width of the recording medium, and an ink tube that passes through gap sections between the guide member and the housing and supplies ink from an ink accommodation portion which is provided outside the housing to a recording head that is attached to a carriage.

In a case in which the recording apparatus is configured in this manner, it is possible to lead the ink tube out to the outside of the housing through the gap sections between the guide member and the housing. Therefore, it is possible to prevent the ink tube from becoming an obstruction when removing a recording medium that has become stuck inside the housing, it is possible to remove the recording medium easily, and it is possible to improve the maintainability of the recording apparatus.

In addition, according to the recording apparatus of another aspect of the present invention, it is preferable that the guide member be provided in a pair and the pair of guide members be capable of defining the width at both ends of the recording medium, gap sections be respectively provided between the pair of guide members and the housing, and the ink tube respectively pass through the gap sections.

In a case in which the recording apparatus is configured in this manner, it is possible to improve the maintainability of the recording apparatus without the ink tube becoming an obstruction when removing a recording medium that has become stuck inside the housing.

Furthermore, according to the recording apparatus of another aspect of the present invention, it is preferable that a foreign matter receiving member, which prevents the intrusion of foreign matter from the first aperture portion, be attached to the housing, the foreign matter receiving member be positioned in a state of facing the paper supply tray, and an abutting portion that abuts against the foreign matter receiving member be provided in the paper supply tray and the foreign matter receiving member and the abutting portion be fixed to one another.

In a case in which the recording apparatus is configured in this manner, it is possible to prevent a situation in which the paper supply tray is stowed in a stowing location by fixing the paper supply tray between the foreign matter receiving member and the abutting portion. As a result of this, it is possible to prevent the ink tube from becoming severed or crushed in a case in which the ink tube is positioned in a stowing pathway of the guide member at the time of stowing the paper supply tray.

In addition, according to the recording apparatus of another aspect of the present invention, it is preferable that one of the guide members among the pair of guide members be a movable guide member that is provided so as to be capable of sliding along the width direction of a tray member, and a spacer be provided between the movable guide member and the housing to correspond to the passing through of the ink tube.

In a case in which the recording apparatus is configured in this manner, it is even possible to prevent the ink tube from becoming crushed by the movable guide member in a case in which the movable guide member is moved toward a section of the housing that faces the movable guide member.

In addition, according to the recording apparatus of another aspect of the present invention, it is preferable that in the housing, a second aperture portion be provided further on a side which is opposite a side on which the carriage is clamped than a location in which the recording medium is positioned and at which recording is performed by the recording head, an opening and closing cover be provided in the housing so as to be capable of rotating and the second aperture portion be opened and closed by rotation of the opening and closing cover, and the ink tube, which extends from an attachment position to the carriage, pass through the second aperture portion from the carriage side and be provided in a state of passing through the gap sections.

In a case in which the recording apparatus is configured in this manner, the ink tube is positioned outside the housing by passing through an aperture section, and the ink tube extends from that position toward the gap sections. As a result of this, it is possible to prevent the ink tube from reaching a scanning pathway of the carriage and becoming an obstacle to the scanning of the carriage.

Furthermore, according to the recording apparatus of another aspect of the present invention, it is preferable that a top panel be provided in the housing on a side that runs from the second aperture portion to a paper supply device, and the ink tube be fixed to the top panel.

In a case in which the recording apparatus is configured in this manner, it is possible to prevent a situation in which the ink tube is shaken at the time of the scanning of the carriage, and it is possible to stabilize the behavior of the ink tube inside the housing.

In addition, according to a recording apparatus of another aspect of the present invention, a recording apparatus is equipped with a paper supply tray that is provided on an upstream side of a transport direction in which a recording medium is transported, which can feed the recording medium from a first aperture portion provided in a housing, and has a first tray member and a second tray member that can extend from the first tray member, and an ink tube that passes through gap sections between a wall portion of the second tray member and the housing, and which supplies ink from an ink accommodation portion that is provided outside the housing to a recording head that is attached to a carriage.

In a case in which the recording apparatus is configured in this manner, it is possible to lead the ink tube out to the outside of the housing through the gap sections between the second tray member and the wall portion. Therefore, it is possible to prevent the ink tube from becoming an obstruction when removing a recording medium that has become stuck inside the housing, it is possible to easily remove the recording medium, and it is possible to improve the maintainability of the recording apparatus.

Furthermore, according to the recording apparatus of another aspect of the present invention, it is preferable that the wall portion function as a guide member that defines the width of the recording medium.

In a case in which the recording apparatus is configured in this manner, it is possible to lead the ink tube out to the outside of the housing the guide member.

In addition, according to the recording apparatus of another aspect of the present invention, it is preferable that a protrusion that protrudes from a placement surface of the second tray member where the recording medium is placed toward a side separated therefrom be provided on a side of the wall portion of the second tray member, and the ink tube be positioned in a state of being hooked onto the protrusion.

In a case in which the recording apparatus is configured in this manner, since the ink tube is hooked onto the protrusion of the side of the wall portion of the second tray member, it is possible to perform positioning of the ink tube and changing of the direction in which the ink tube is drawn out using the protrusion.

Furthermore, according to the recording apparatus of another aspect of the present invention, it is preferable that a foreign matter receiving member, which prevents the intrusion of foreign matter from the first aperture portion, be attached to the housing, and the foreign matter receiving member be provided in a position that faces the paper supply tray.

In a case in which the recording apparatus is configured in this manner, using the foreign matter receiving member, it is possible to prevent a situation in which foreign matter such as dust and the like gets into the housing when the paper supply tray is not being used.

In addition, according to the recording apparatus of another aspect of the present invention, it is preferable that the foreign matter receiving member and the protrusion be fixed to one another.

In a case in which the recording apparatus is configured in this manner, it is possible to prevent a situation in which the paper supply tray is stowed in a stowing location by fixing the paper supply tray between the foreign matter receiving member and the protrusion. As a result of this, it is possible to prevent the ink tube from becoming severed or crushed in a case in which the ink tube is positioned in a stowing pathway of the guide member at the time of stowing the paper supply tray.

Furthermore, according to the recording apparatus of another aspect of the present invention, it is preferable that a guide member that defines the width of the recording medium and faces the housing be provided in the second tray member.

In a case in which the recording apparatus is configured in this manner, it is possible to lead the ink tube to the outside of the housing the guide member. In addition, it is possible to define the width of the recording medium using the guide member.

In addition, according to the recording apparatus of another aspect of the present invention, it is preferable that the guide member be provided in a pair and the pair of guide members be capable of defining the width at both ends of the recording medium.

In a case in which the recording apparatus is configured in this manner, it is possible to lead the ink tube out to the outside of the housing the pair of guide members. In addition, it is possible to define the width of the recording medium using the pair of guide members.

Furthermore, according to the recording apparatus of another aspect of the present invention, it is preferable that one of the guide members among the pair of guide members be a movable guide member that is provided so as to be capable of sliding along the width direction of the second tray member.

In a case in which the recording apparatus is configured in this manner, it is possible to lead the ink tube out to the outside of the housing the movable guide member.

Furthermore, according to the recording apparatus of another aspect of the present invention, it is preferable that a spacer be provided between the movable guide member and the housing to correspond to the passing through of the ink tube.

In a case in which the recording apparatus is configured in this manner, it is even possible to prevent the ink tube from becoming crushed by the movable guide member in a case in which the movable guide member is moved toward a section of the housing that faces the movable guide member.

DESCRIPTION OF EMBODIMENTS

Hereinafter, a recording apparatus 10 of an embodiment of the present invention will be described with reference to the drawings. Additionally, in the following description, the downstream side of the transport direction of recording paper P will be referred to as a front-end portion and the upstream side that is opposite thereto will be referred to as a rear-end portion. In addition, the transport direction (sub-scanning direction) of the recording paper P will be referred to as a Y direction and a direction (main scanning direction) that is orthogonal thereto and in which the carriage moves will be referred to as an X direction.

In addition, the recording paper P corresponds to one example of a recording medium, but for example, the recording medium may be set as a recording target object other than the recording paper P such as a film-like member.

1. Summary

The present invention relates to disposition embodiments of an ink tube that is connected to an external tank 60 in a recording apparatus 10. Hereinafter, disposition embodiments of an ink tube 50 will be described in sequence along with other embodiments. Additionally, in the following invention, although there are cases in which the description is given with an XYZ orthogonal coordinate system, among the coordinate system, a direction in which a carriage 41 moves (scans) is referred to as an X direction, a direction (vertical direction) in which is separated from the installation surface of the recording apparatus 10 is referred to as a Z direction and a direction (sub-scanning direction) which is orthogonal to the X direction and the Z direction is referred to as the Y direction.

(Disposition Embodiments of Ink Tube)

Figure 1:
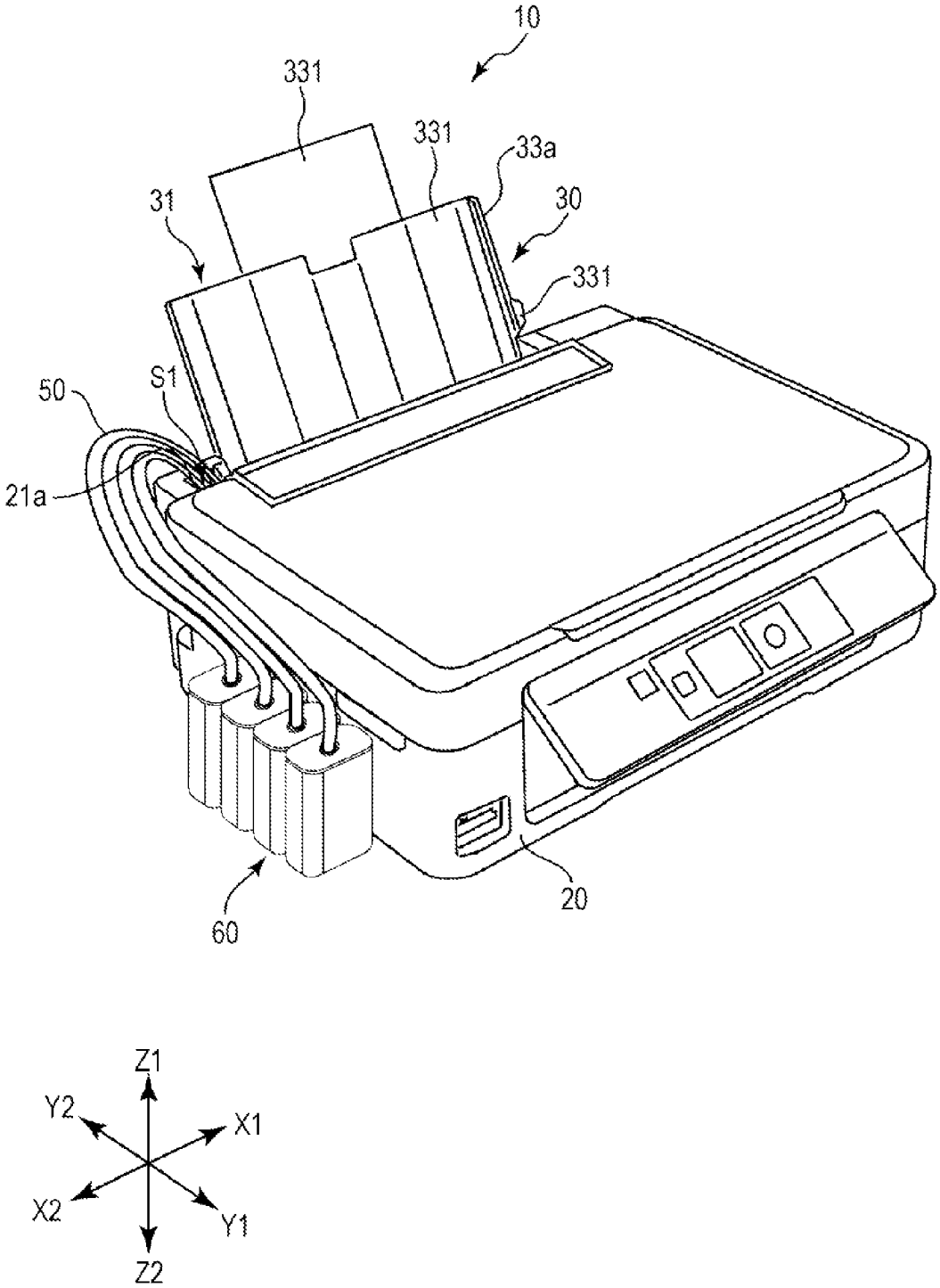
FIG. 1 is a perspective view that shows the configuration of a recording apparatus.
Figure 2:
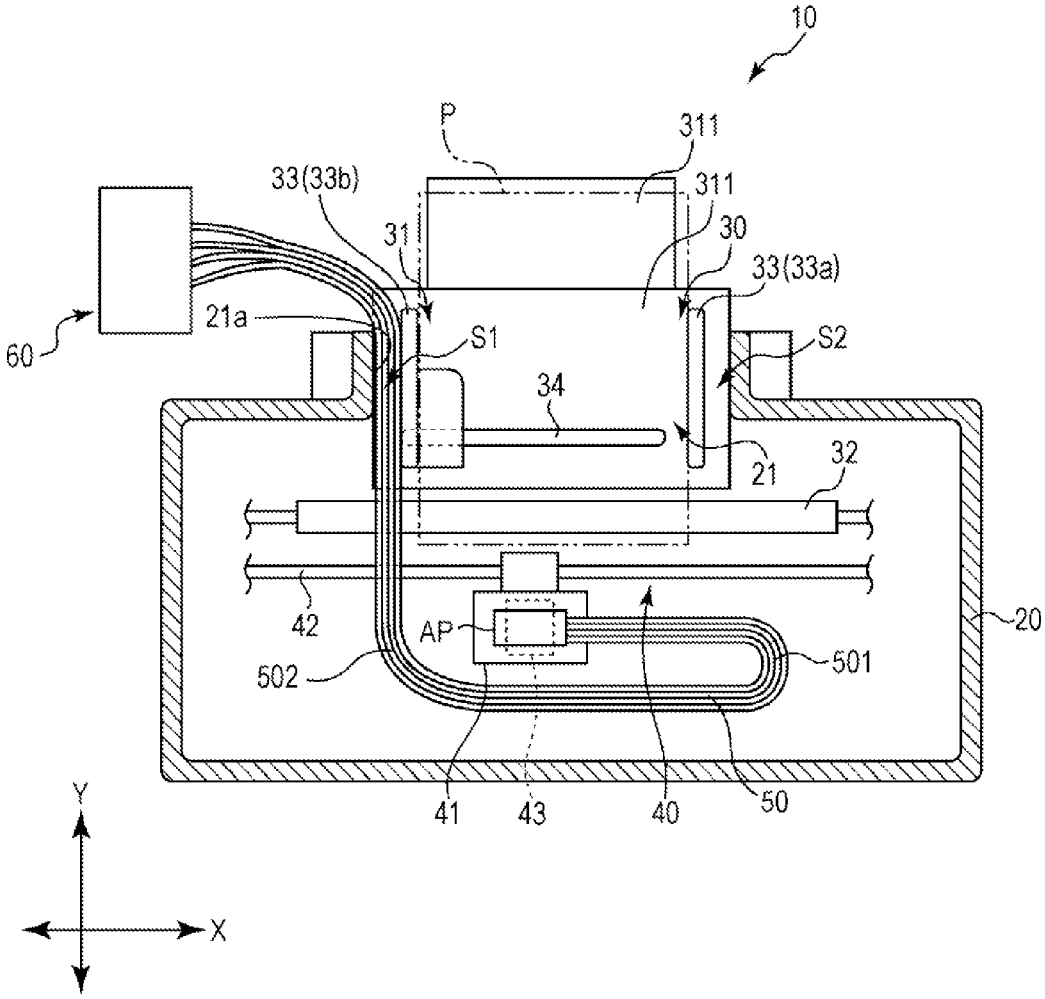
FIG. 2 is a schematic view that shows a state in which an ink tube is led out from a gap section.

FIG. 1 is a perspective view of the recording apparatus 10 of the present invention. In addition, FIG. 2 is a schematic view that shows an outline of the main sections of the recording apparatus 10. The recording apparatus 10 is provided with a housing 20, a paper supply device 30, a carriage mechanism 40 and an ink tube 50. In addition, the recording apparatus 10 may be configured to have a configuration that is provided with an external tank 60 in addition to the abovementioned components, or may be configured to have a configuration that is not provided with an external tank 60. An aperture portion 21 (corresponds to a first aperture portion) is provided on the back surface side of the housing 20. The aperture portion 21 is a section in which a section of the back surface side of the housing 20 has been cut away, and in the present embodiment, the aperture portion 21 is formed so that the main scanning direction (the X direction) is longitudinal.

It is possible to supply the recording paper P from the paper supply device 30 inside the housing 20 through the aperture portion 21. The paper supply device 30 has a paper supply tray 31 and an isolation roller 32. The paper supply tray 31 is a section that carries the recording paper P and supports the recording paper P from the back surface side. The paper supply tray 31 may be configured from a single tray member 311 or may be configured from a plurality of tray members 311. In a case in which the paper supply tray 31 is configured from a plurality of tray members 311, the plurality of tray members 311 are provided to be capable of being drawn out or stowable depending on the size of the recording paper P. In the recording apparatus 10 shown in FIG. 1, a tray member 311 with two levels is displayed, but in the recording apparatus 10 of FIG. 1, there is a level of the tray member 311 that is hidden by the housing 20. Therefore, in the recording apparatus 10 of FIG. 1, the paper supply tray 31 is configured from a tray member 311 with a total of three levels. Considering this, among the three-levelled tray member 311, the lowest level of the tray member 311 corresponds to a first tray member, and a tray member 311 that extends from that tray member 311 (the first tray member) corresponds to a second tray member. In addition, even in a case of a two-levelled tray member 311, the lowest level of the tray member 311 corresponds to the first tray member and the tray member 311 that extends from that tray member 311 (the first tray member) corresponds to the second tray member. Additionally, the size of the tray member 311 is provided so as to gradually become smaller with movement toward the upstream side of the transport direction from the downstream side, and is provided such that a small tray member 311 is stowed in the internal space of a large tray member 311.

Additionally, in the recording apparatus 10 shown in FIG. 1, a wall-like fixed guide member 33*a* is provided in the tray member 311, and a protrusion 331 is provided at the lower side of this fixed guide member 33*a*. The protrusion 331 protrudes toward a direction that is separated from the tray member 311.

A guide member 33 is provided in the tray member 311 at the downstream side of the transport direction. The guide member 33 guides the position of the end portion of the width direction of the recording paper P, and is a member that prevents a situation in which the recording paper P is transported in a diagonal state or the like. A fixed guide member 33*a* and a movable guide member 33*b* are provided in the guide member 33. The fixed guide member 33*a* is provided in a fixed manner with respect to the tray member 311, and is provided so that positional movement in the main scanning direction (the X direction) is not possible. The movable guide member 33*b* is configured to be capable of movement along the main scanning direction (the X direction) using a sliding guide (not shown in the drawing) that is provided on the back surface side of a guide groove 34 and the tray member 311 in FIG. 2. As a result of this, the width between the pair of guide members 33 can be changed depending on the width of the recording paper P, and it is possible to feed the recording paper P to the side of the isolation roller 32 while preventing a situation in which the recording paper P becomes inclined.

Additionally, the isolation roller 32 is provided at an end portion of the downstream side provided in the transport direction of the paper supply tray 31. The isolation roller 32 is revolved by drive power being applied by a motor (not shown in the drawing), and it is possible to transport the recording paper P to the downstream side.

In addition, a carriage mechanism 40 that is provided with a carriage 41 is provided inside the housing 20. The carriage 41 is capable of moving in the main scanning direction (the X direction) along a carriage axis 42 due to the driving of a carriage motor (not shown in the drawing). Additionally, a recording head 43 is attached to a side of the carriage 41 that faces the transport path, ink is sprayed from the recording head 43, and it is possible to form a recording image of the recording paper P.

One end side of the ink tube 50 is attached to the carriage 41 through an adapter AP. The other end side of the ink tube 50 is connected to an external tank 60 that is on the outside of the housing 20. Further, it is possible to supply ink to the recording head 43 from the external tank 60 through the ink tube 50 and the adapter AP. Additionally, the carriage 41 includes a type that mounts an ink cartridge which is provided with memory. In this case, it is possible to provide a connection portion that reads the information of the memory, to the carriage 41, but it also possible to adopt a configuration in which an adapter AP is provided in a section (a connection portion on the side of the adapter), which is electrically connected to such a connection portion. In such a case, by performing transmission and reception of signals between the connection portion on the side of the adapter and the connection portion, it is possible to configure a state in which the recording head 43 operates normally.

Incidentally, the ink tube 50 that is connected between the carriage 41 and the external tank 60 is disposed in the following manner. In a case of proceeding from the carriage 41 along the ink tube 50, as shown in FIG. 2, after proceeding toward one side for a predetermined distance, the direction, in which the ink tube 50 that extends from the carriage 41 toward one side in the main scanning direction (the X direction), is reversed after passing the curved portion 501. As a result of this, proceeding along the ink tube 50 becomes proceeding toward the other side in the main scanning direction (the X direction). Further, proceeding for a predetermined distance reaches the turning portion 502 of the ink tube 50. The turning portion 502 is a section that turns the direction of the ink tube 50, and as specifically shown in FIG. 2, turns the direction of the ink tube 50 from a state in which the ink tube 50 proceeds along the main scanning direction (the X direction) to a state in which the ink tube 50 passes the aperture portion 21 and proceeds along the paper supply tray 31 (tray member 311).

Additionally, provided the direction of ink tube 50 is turned to proceed along the paper supply tray 31 (tray member 311), the length of the turning portion 502 is not limited.

In this case, as shown in FIG. 2, in the present embodiment, the ink tube 50 that has passed the turning portion 502 is positioned in a gap section S1 that is clamped between an inner wall portion 21*a* (corresponding to a wall surface portion) of the aperture portion 21 and a side surface portion of the movable guide member 33*b*, and is led to the outside of the housing 20 through the gap section S1. Further, after the ink tube 50 has proceeded along the paper supply tray 31 (tray member 311) for a predetermined distance, the ink tube 50 becomes separated from the paper supply tray 31 (tray member 311) and proceeds toward the external tank 60. In this manner, in the configuration shown in FIG. 2, the ink tube 50 reaches the gap section S1 after passing the turning portion 502 and is led to the outside of the housing 20 through the gap section S1. As a result of this, the ink tube 50 extends toward the upper side and the front side of the recording apparatus 10, and as a result of this extension, it is possible to prevent a situation in which a user is impeded from removing recording paper P that is stuck by putting their hand into the transport path when recording paper P is stuck in the transport path.

Figure 13:
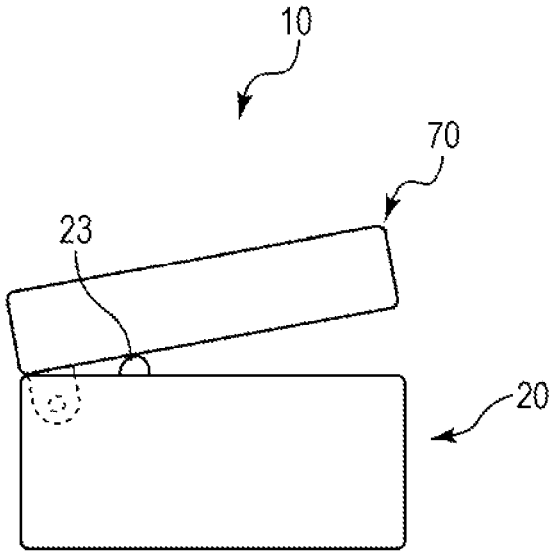
FIG. 13 is a lateral view that shows a state in which the opening and closing cover is prevented from closing completely.

In addition, as shown in FIG. 1 and FIG. 2, in a case in which the ink tube 50 is led out to the outside of the housing 20, since a state in which the ink tube 50 passes through the aperture portion 21 of the housing 20 is attained, it is possible to prevent a situation in which the ink tube 50 is clamped in an opening and closing cover 70 (refer to FIG. 13; for example, a lid section, a scanning unit 12 (refer to FIG. 19) and the like correspond to the opening and closing cover 70) of the recording apparatus 10.

Figure 3:
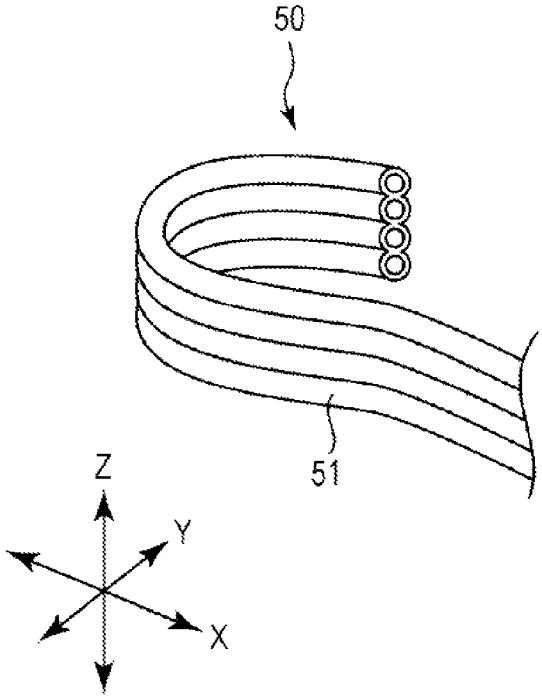
FIG. 3 is a partial perspective view that shows the configuration of the ink tube.
Figure 4:
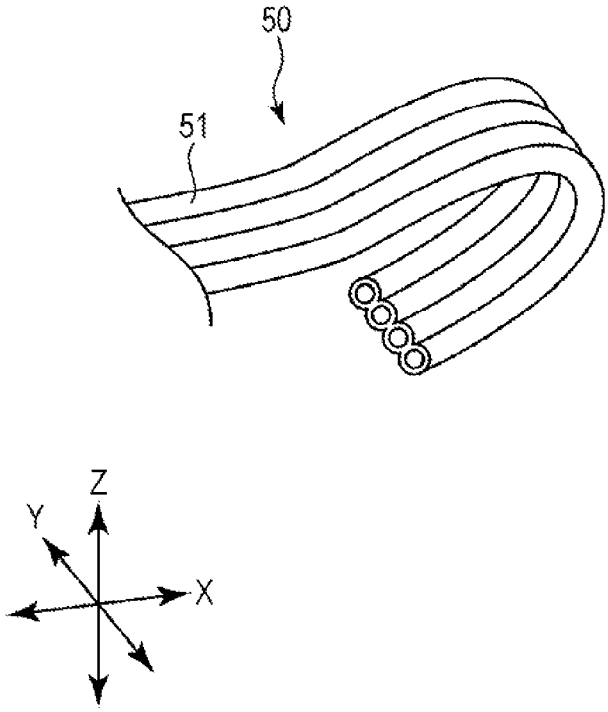
FIG. 4 is a partial perspective view that shows the configuration of the ink tube.

In addition, as shown in FIG. 3, the ink tube 50 has a configuration in which tube sections 51 which respectively conduct different types of ink, are lined up and joined. In the configuration shown in FIG. 3, a configuration in which the lined up plurality of tube sections 51 are unified, is used. However, a configuration in which the respective tube sections 51 are not joined and can move freely is also possible. In addition, in the recording apparatus 10 shown in FIG. 1 and FIG. 2, as shown in FIG. 3, the ink tube 50 is curved so that the vertical direction (the Z direction) is wide in addition to making a curve in a plane (an XY plane) formed by the main scanning direction (the X direction) and the sub-scanning direction (the Y direction). However, as shown in FIG. 4, the ink tube 50 may be curved so that the sub-scanning direction (the Y direction) is wide in addition to making a curve in a plane (an XZ plane) formed by the main scanning direction (the X direction) and the vertical direction (the Z direction). Further, in the ink tube 50, in addition to configuring the direction of the sequence of the tube sections 51 to be lined up in one direction in a cross-section of the tube sections 51, the direction of the sequence of the tube sections 51 may be configured to be lined up in a direction that is orthogonal to the direction in the cross-section.

In addition, in the configuration shown in FIG. 2, the ink tube 50 is positioned further on the front side than the carriage 41 in the sub-scanning direction (the Y direction) when moving toward the external tank 60 after passing the curved portion 501, and thereafter, is bent so as to move toward the gap section S1 after passing the turning portion 502. However, the ink tube 50 may be bent in the manner shown in FIG. 5. In the configuration shown in FIG. 5, the ink tube 50 is positioned on the back surface side of the carriage 41 without being positioned further on the front side than the carriage 41 when moving toward the external tank 60 after passing the curved portion 501, and thereafter, is bent so as to move toward the gap section S1 after passing the turning portion 502.

First Different Embodiment

Figure 5:
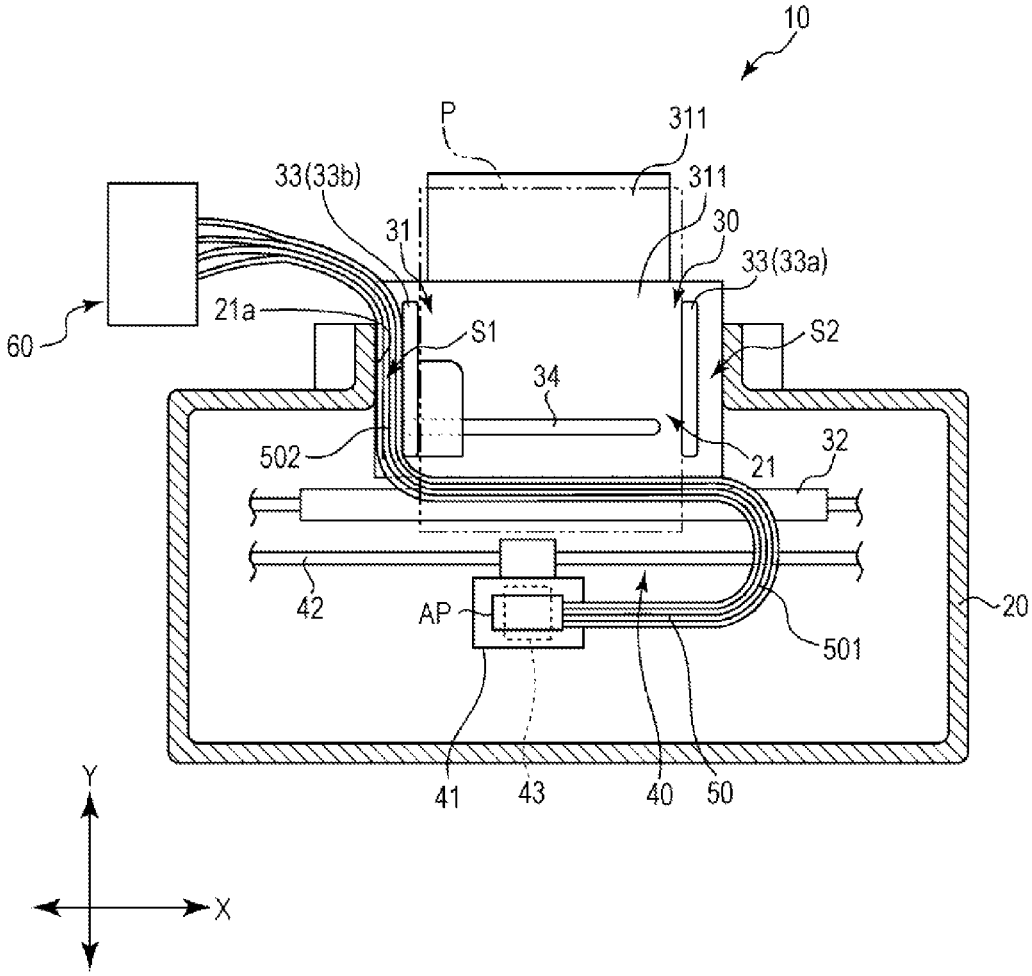
FIG. 5 is a schematic view that shows another embodiment of the ink tube being led out from a gap section.
Figure 6:
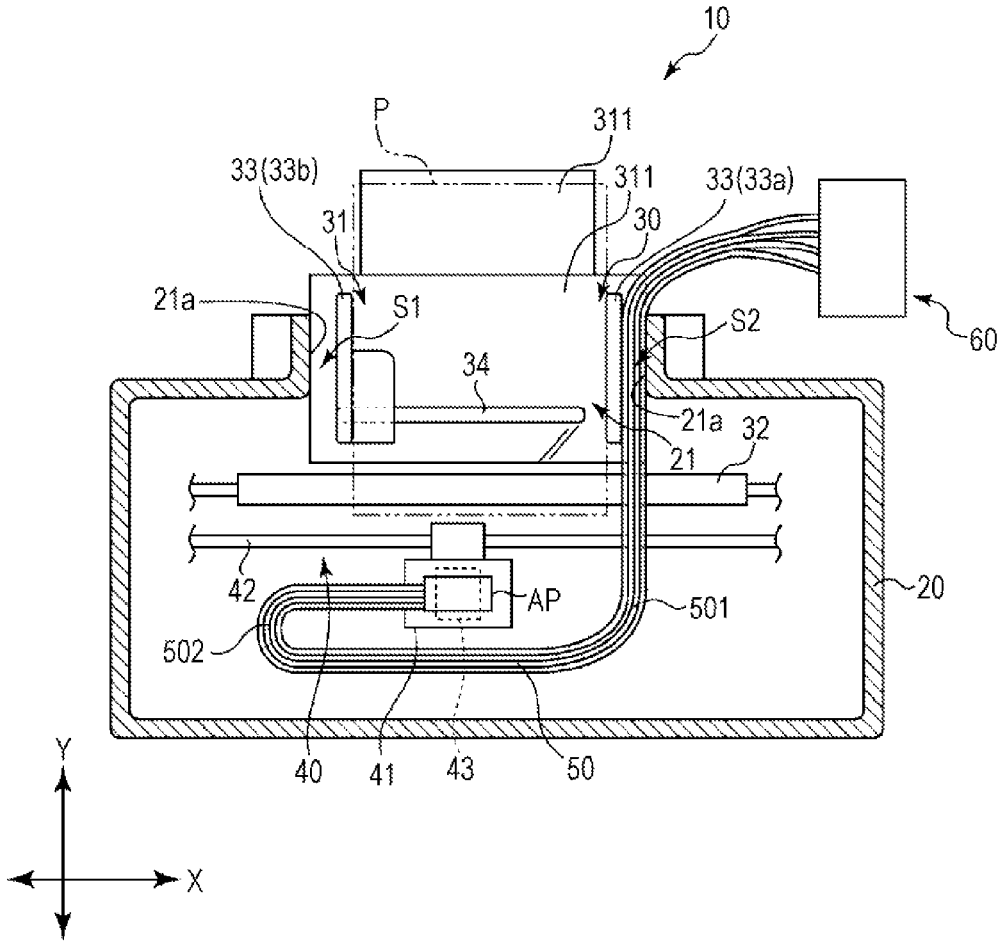
FIG. 6 is a schematic view that shows another embodiment of the ink tube being led out from a gap section.

Additionally, in the configuration shown in FIG. 1 and FIG. 2, a configuration in which the ink tube 50 is led out to the outside of the housing 20 by passing the gap section S1 that is clamped between an inner wall portion 21*a* of the aperture portion 21 and a side surface portion of the movable guide member 33*b* is described, but the configuration that leads the ink tube 50 out to the outside is not limited to the configuration shown in FIG. 1, FIG. 2 and FIG. 5. For example, as shown in FIG. 6, a configuration in which the ink tube 50 is led out to the external tank 60 by passing a gap section S2 that is clamped between an inner wall portion 21*a* of the aperture portion 21 and a side surface portion of the fixed guide member 33*a* is also possible. Even when the ink tube 50 is led out in this manner, it is possible to lead the ink tube 50 out to the outside of the housing 20 in a favorable manner. In addition, it is possible to prevent a situation in which a user is impeded from removing recording paper P that is stuck by putting their hand into the transport path when recording paper P is stuck in the transport path. Furthermore, in the same manner as the case of FIG. 1 and FIG. 2, it is possible to prevent a situation in which the ink tube 50 is clamped in an opening and closing cover 70 (refer to FIG. 13) of the recording apparatus 10.

Figure 7:
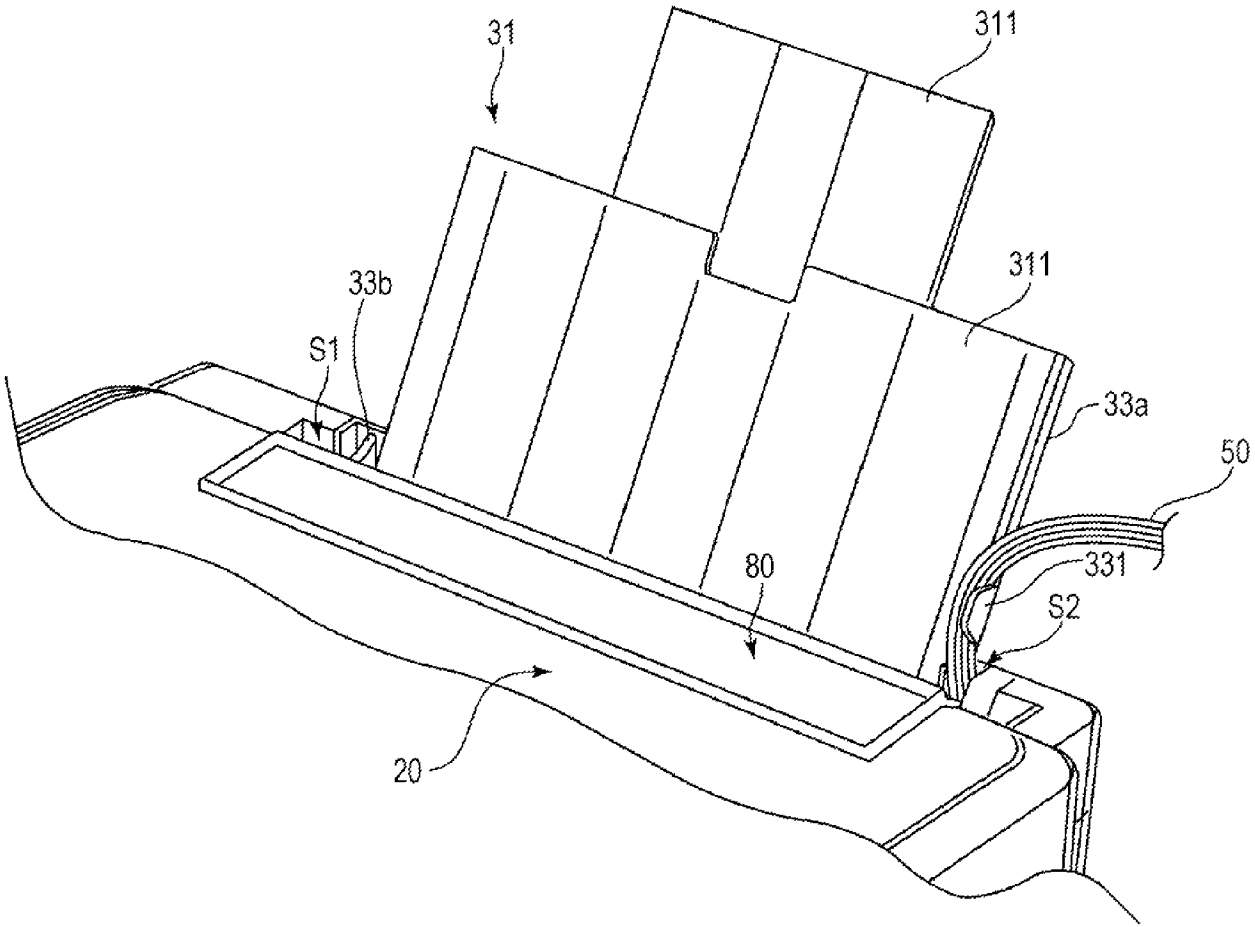
FIG. 7 is a perspective view that shows a state in which the ink tube is hooked onto a protrusion.
Figure 8:
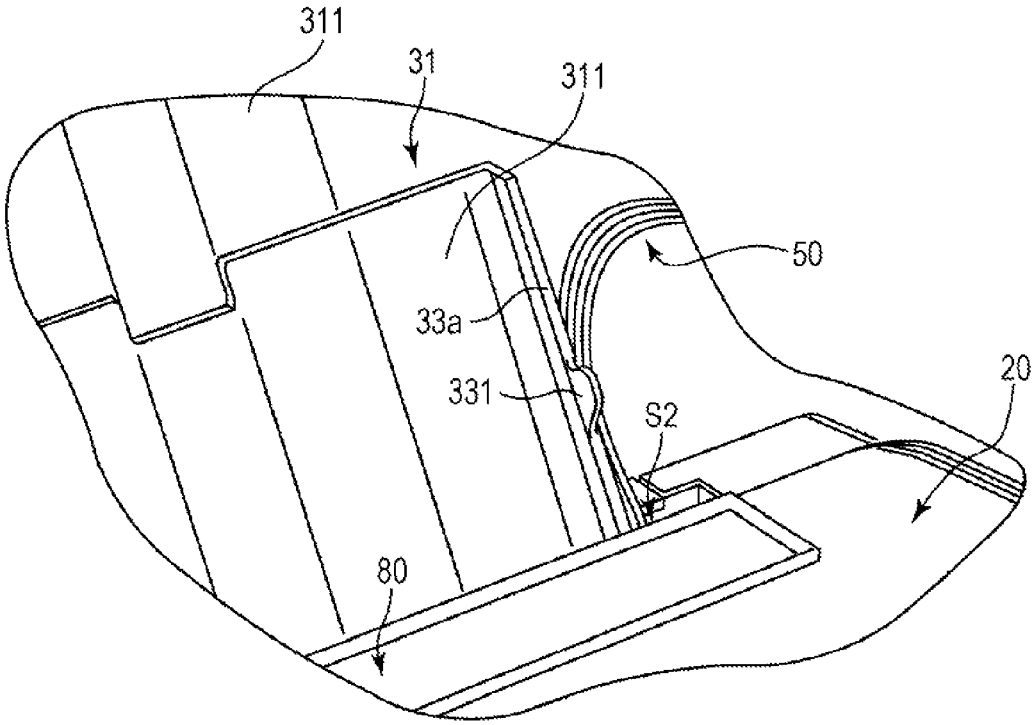
FIG. 8 is a perspective view that shows a state in which the ink tube is not hooked onto a protrusion.

Additionally, in a case in which the ink tube 50 is led out to the outside of the housing 20 by passing a gap section S2 such as that shown in FIG. 6, a configuration such as that shown in FIG. 7 may be adopted. In FIG. 7, the ink tube 50 is in a state of being hooked onto the protrusion 331, and after the hooking (abutting) onto the protrusion 331, the ink tube 50 extends toward the external tank 60. In a case in which such a configuration is adopted, it is possible to use the protrusion 331 for the positioning of the ink tube 50 when the ink tube 50 is led out to the outside of the housing 20. In addition, it is possible to change the direction in which the ink tube 50 is drawn out using the protrusion 331. However, as shown in FIG. 8, a configuration in which the ink tube 50 is led out to the outside of the housing 20 without being hooked onto the protrusion 331 may also be adopted. Naturally, even when a direction of leading the ink tube 50 out such as that shown in FIG. 8 is adopted, it is possible to lead the ink tube 50 out from the housing 20 in a favorable manner.

Figure 9:
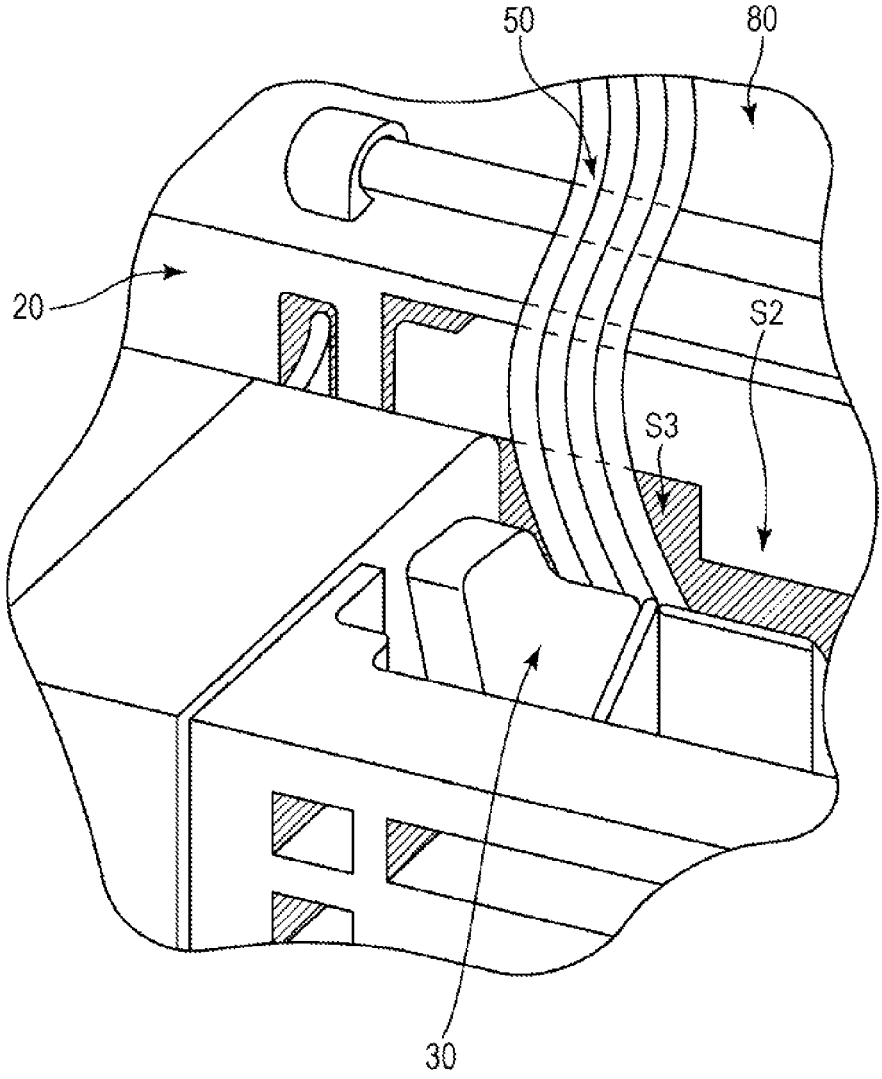
FIG. 9 is a perspective view that shows a state in which the ink tube is led out from a notched portion of the back surface side.
Figure 9:
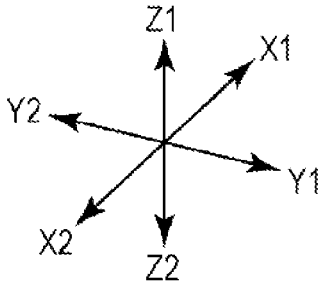

In addition, a configuration in which a notched portion S3 such as that shown in FIG. 9 is provided in the housing 20 in the vicinity of the gap section S2 is also possible. That is, in a case in which the gap section S2 is not sufficiently large or there is no leeway in the drawing out of the ink tube 50 from the inside of the housing 20, the recording apparatus 10 may be configured with a notched portion S3 such as that shown in FIG. 9 provided therein. Additionally, in FIG. 9, a configuration that is provided with the notched portion S3 in the gap section S2 is shown, but the notched portion S3 may be provided in a location other than the gap section S2. For example, the notched portion S3 may be provided in the gap section S1, the notched portion S3 may be provided in another area of the housing 20, or the notched portion S3 may be provided in the housing of the paper supply device 30 or the like as opposed to being provided in the housing 20.

Second Different Embodiment

Figure 10:
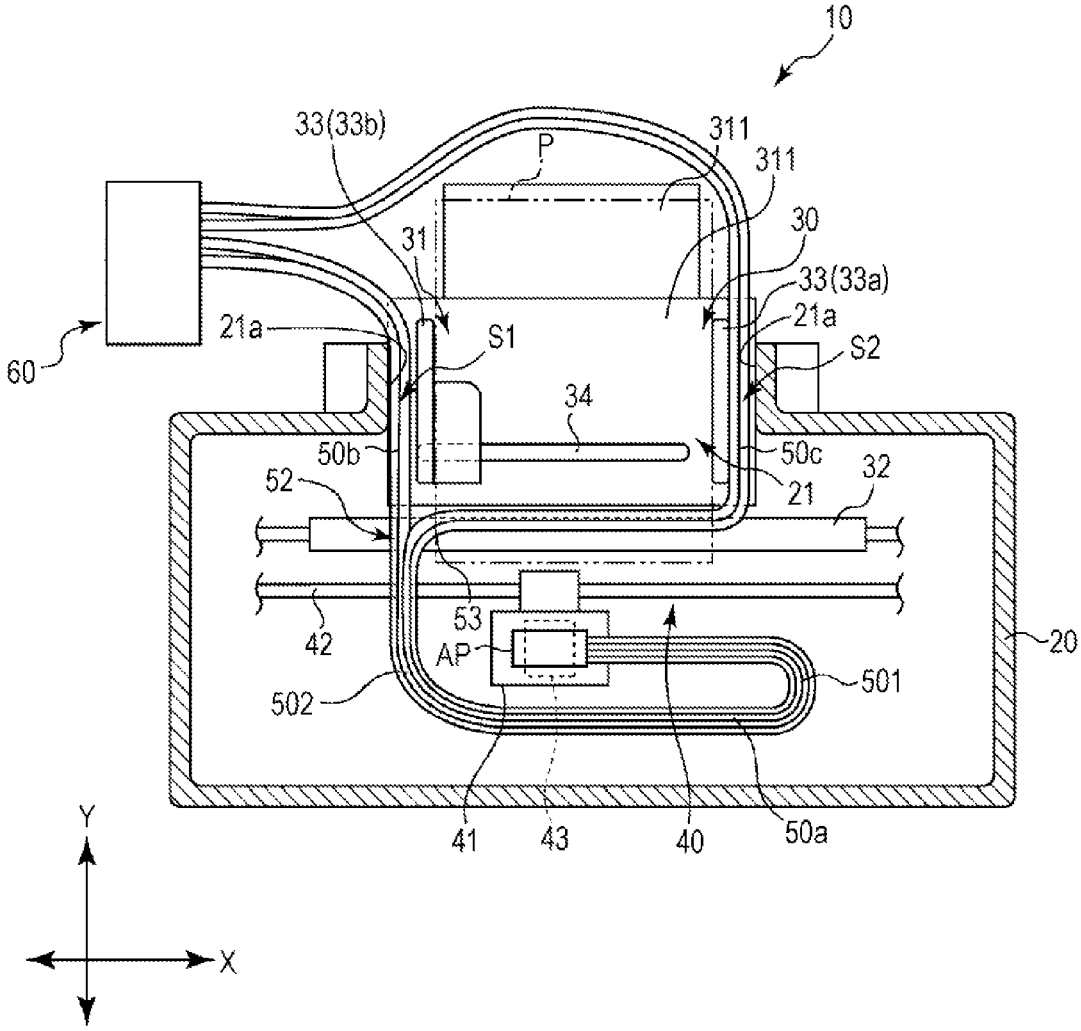
FIG. 10 is a schematic view that shows another embodiment of the ink tube being led out from the gap section.

In addition, a configuration such as that shown in FIG. 10 is also possible. In FIG. 10, the ink tube 50 has a configuration in which the ink tube 50 is led out to the outside of the housing 20 by passing the two gap sections S1 and S2. In this case, the two gap sections S1 and S2 indicate a gap section S1 that is surrounded by the inner wall portion 21*a* of the aperture portion 21 and a side surface portion of the movable guide member 33*b*, and a gap section S2 which is surrounded by the inner wall portion 21*a* of the aperture portion 21 and a side surface portion of the fixed guide member 33*a*.

In order to lead the ink tube 50 out to the outside of the housing 20 from the two gap sections S1 and S2, it is necessary to branch the ink tube 50 in two. That is, there is an unbranched tube 50*a*, a first branched tube 50*b* and a second branched tube 50*c* in the ink tube 50. The unbranched tube 50*a* is a section of the ink tube 50, which is not branched, from the carriage 41 to a branched portion 52, the first branched tube 50*b* is a section of the ink tube 50 from the branched portion 52 that passes the gap section S1 and reaches the external tank 60, and the second branched tube 50*c* is a section of the ink tube 50 from the branched portion 52 that passes the gap section S2 and reaches the external tank 60.

Additionally, there may also be a section, which is adjacent to the branched portion 52, that greatly turns the direction of the branched tubes 50*b* and 50*c* in at least one of the first branched tube 50*b* and the second branched tube 50*c*. That is, in the configuration shown in FIG. 10, for example, there is a curving section 53 in the second branched tube 50*c*, which curves so as to greatly invert the direction of the second branched tube 50*c* after passing the branched portion 52 when moving toward the external tank 60 from the branched portion 52, but without being limited to the second branched tube 50*c*, there may be such a curving section 53 that inverts the direction in the first branched tube 50*b* and there may be such sections that curve so as to invert the direction in both the first branched tube 50*b* and the second branched tube 50*c*.

Third Different Embodiment

Figure 11:
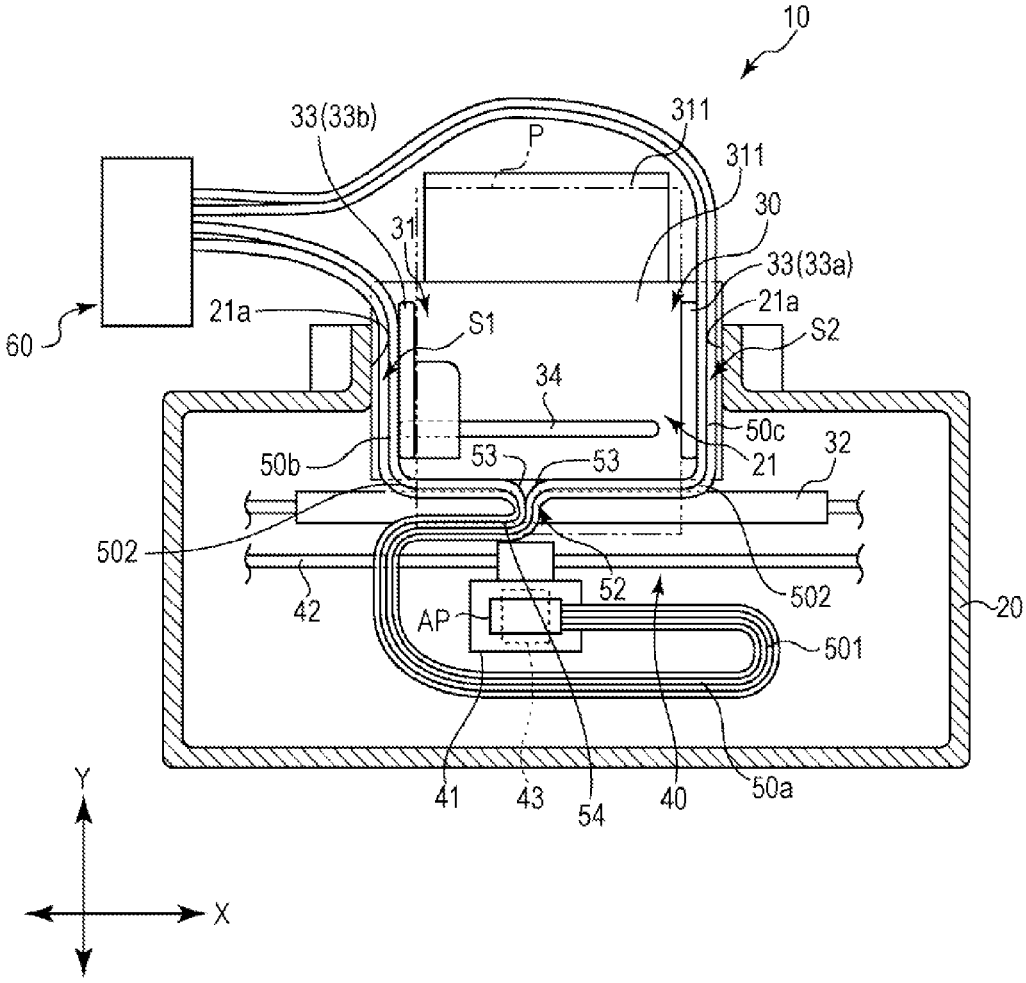
FIG. 11 is a schematic view that shows another embodiment of the ink tube being led out from the gap section.

Further, in the configuration shown in FIG. 11, in addition to there being a location (unbranched turning portion 54) that greatly turns the direction of the unbranched tube 50*a* in a front location that reaches the branched portion 52 in the unbranched tube 50*a*, there may be respective curving sections 53 that curve so as to turn the directions of the branched tubes 50*b* and 50*c* in the first branched tube 50*b* and the second branched tube 50*c*. The curving section 53 is a section that turns (curves) so that the directions in which the branched tubes 50*b* and 50*c* extend from the branched portion 52 respectively move toward both end sides in the main scanning direction (the X direction) between the abovementioned turning portion 502.

Fourth Different Embodiment

Figure 12:
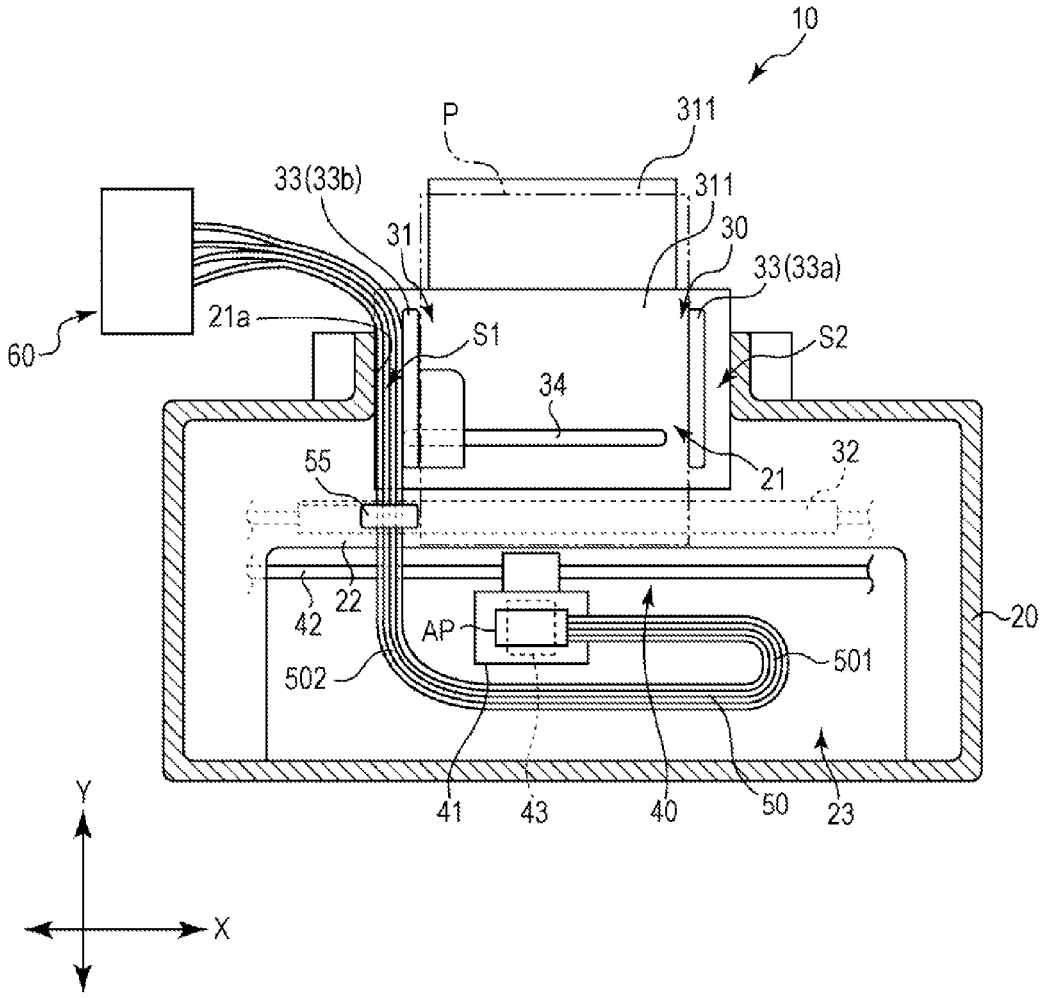
FIG. 12 is a schematic view that shows another embodiment of the ink tube being led out from the gap section.

In addition, as shown in FIG. 12, a configuration in which there is a fixing member 55 that fixes a section of the ink tube 50 to a top panel 22 in a state in which the top panel 22 is exposed when the opening and closing cover 70 (refer to FIG. 13) is open may be used. However, it is necessary that this configuration does not impede the sliding of the carriage 41 when the carriage 41 slides along the carriage axis 42. Therefore, even when the carriage 41 is positioned at either end side of a scan in the main scanning direction (the X direction), the ink tube 50 is provided to be a predetermined amount longer than the length with which the longer side of either the fixing member 55 and one end side or the fixing member 55 and the other end side are linked. Additionally, in the configuration shown in FIG. 12, a section of the inside of the housing 20 that is not surrounded by the top panel 22 is an aperture section 23 (corresponding to the second aperture section).

In this case, in the configuration shown in FIG. 12, in a case in which the ink tube 50 is crushed by the ink tube 50 being clamped between the opening and closing cover 70 and the top panel 22 when the opening and closing cover 70 is closed, a configuration such as that shown in FIG. 13 may be used. In FIG. 13, a boss 24 is provided in any location of the housing 20. This boss 24 is a section that secures a gap that is greater than or equal to an amount that ensures that the ink tube 50 does not become crushed between the opening and closing cover 70 and the top panel 22 even in a case in which the opening and closing cover 70 is closed.

Fifth Different Embodiment

Figure 14:
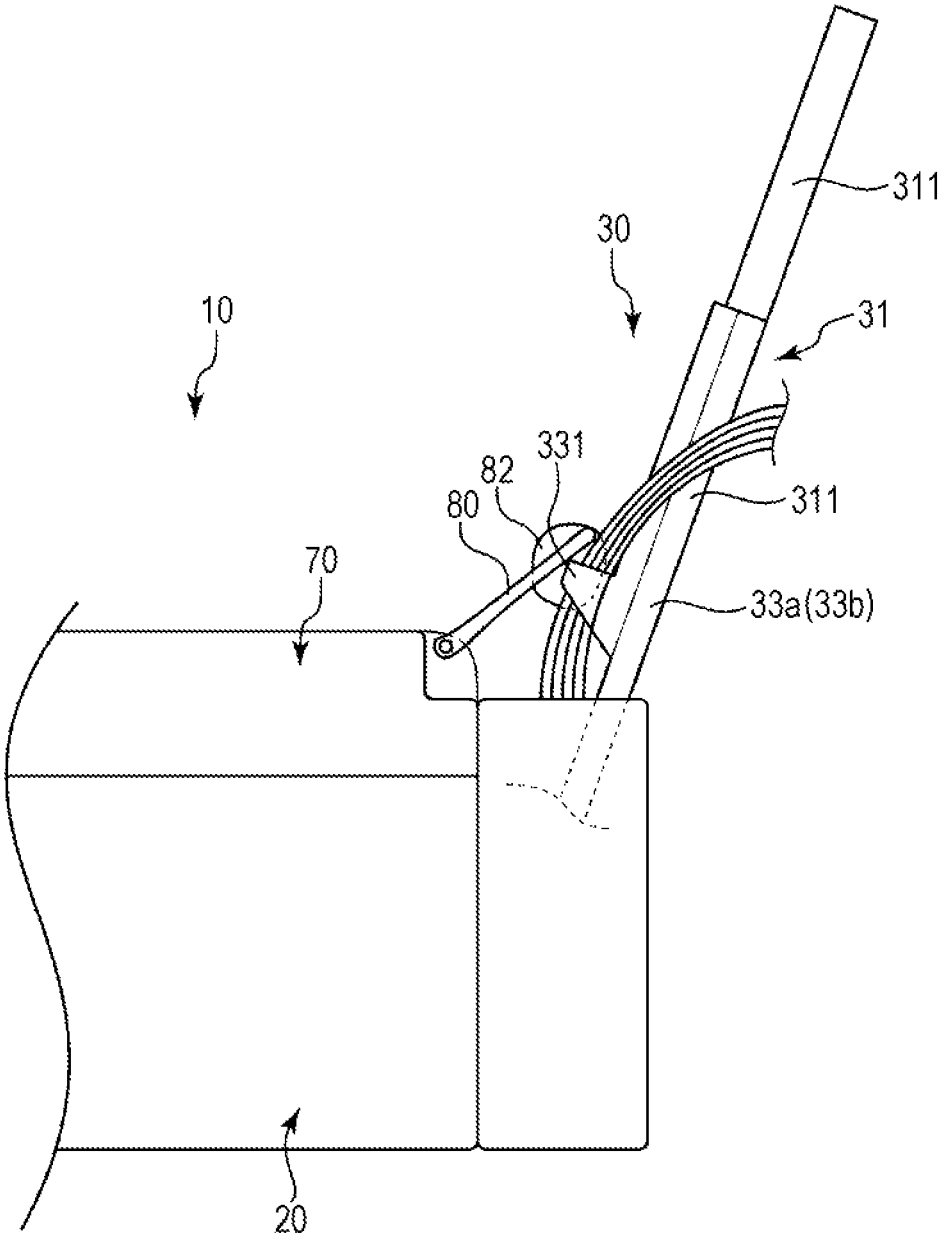
FIG. 14 is a lateral view that shows a state in which a foreign matter receiving member and a protrusion are fixed to one another.

In addition, as shown in FIG. 14, there are cases in which the recording apparatus 10 is provided with a foreign matter receiving member 80 for preventing the ingress of foreign matter from the aperture portion 21. In the configuration shown in FIG. 14, a configuration in which the foreign matter receiving member 80 is received by the protrusion 331 (corresponding to an abutting portion) that is on at least one of the fixed guide member 33*a* or the movable guide member 33*b*, is adopted. As shown in FIG. 14, this protrusion 331 protrudes from at least one of the fixed guide member 33*a* and the movable guide member 33*b*, and in addition, protrudes toward a direction that is separated from the tray member 311. Therefore, in the state that is shown in FIG. 14, the protrusion 331 is provided so as to be positioned further on a front surface side than other sections of the fixed guide member 33*a* or the movable guide member 33*b*, and as a result of this, the protrusion 331 is capable of abutting against the foreign matter receiving member 80.

In such a configuration, in a case in which the paper supply tray 31 is configured by a plurality of tray members 311, there is a concern that the protrusion 331 will crush the ink tube 50 or sever the ink tube 50 when the tray members 311 are stowed. That is, the protrusion 331 is provided on a guide member 33 of the tray member 311 that is positioned lowest. Further, since the guide member 33 also reaches a state of being positioned on an upper side in a state in which the tray member 311 is drawn out, the gap sections S1 and S2 are relatively positioned on upper sides. Meanwhile, in a state in which the tray member 311 is drawn out, there are cases in which the ink tube 50 that is positioned further on the inside of the housing 20 than the gap sections S1 and S2 is in a state of being curved toward the centre of the housing 20 or the like so as to be positioned in a location in which the ink tube 50 is positioned when the tray member 311 is stowed. In such a state, if the lower tray member 311 is stowed in a stowing location, there is a concern that the ink tube 50 that is positioned in a stowing pathway (the lower side of the stowing pathway) of the guide member 33 will be severed or crushed 27 at the time of stowing.

In order to prevent the occurrence of such a situation, the foreign matter receiving member 80 and the protrusion 331 may be fixed with a fixing member 82. This fixing member 82 is a member that does not allow a change in the relative positions of the foreign matter receiving member 80 and the tray member 311 (the protrusion 331), and for example, it is possible to use bonding means or the like such as a tape member, an adhesive, a clipping member, wire.

Figure 15:
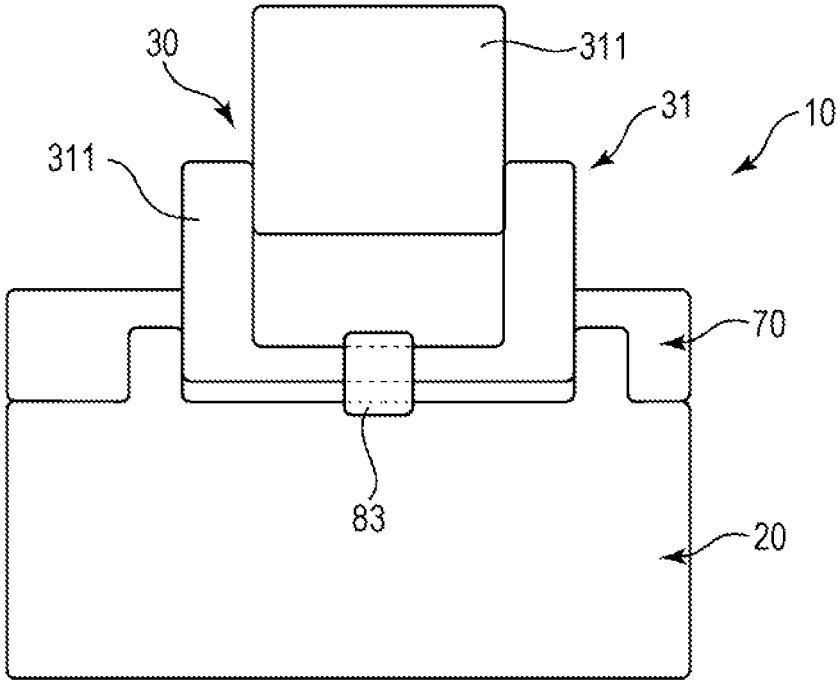
FIG. 15 is a view that shows a state in which a tray member is fixed at the back surface side by a fixing member.

In addition, in place of FIG. 14, a configuration such as that shown in FIG. 15 may be used. FIG. 15 is a view that shows a state in which the recording apparatus 10 is viewed from the back surface side, but as shown in FIG. 15, a stowing location and a tray member 311 may be fixed with a fixing member 83 so that a tray member 311 that is positioned lowest cannot be stowed in the stowing location. In such a case, the same member as that of the fixing member 82 may be used as the fixing member 83.

Sixth Different Embodiment

Figure 16:
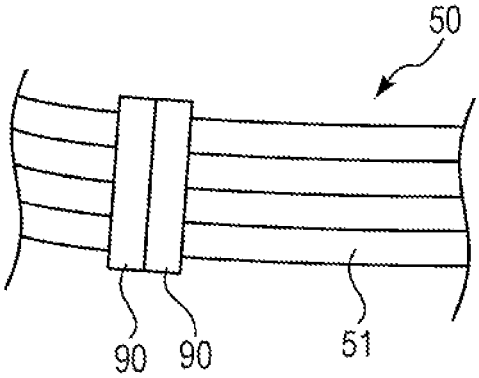
FIG. 16 is a view that shows a joined state of a segmented ink tube via a coupling.

In addition, as shown in FIG. 16, a configuration in which the ink tube 50 is capable of being segmented may be used. That is, there are cases in which the handling of the ink tube 50 is troublesome if the ink tube 50 is long. In response to such cases, as shown in FIG. 16, the ink tube 50 may be configured to be capable of being segmented. In the configuration shown in FIG. 16, the respective segmented ink tube 50 can be joined via a coupling 90. However, since it is necessary that this coupling 90 pass through the abovementioned gap sections S1 and S2, it is necessary to form the coupling 90 to be small enough to be capable of passing through the gap sections S1 and S2. However, the coupling 90 itself may have a configuration which is connected to the respective segmented ink tube 50 at a later stage, and in such a case, the coupling 90 may be provided to be larger than the gap sections S1 and S2. In addition, a configuration in which the coupling 90 is provided for each tube section 51 is also possible, and in such a case, it is possible to make the coupling 90 smaller than the coupling 90 shown in FIG. 16.

Additionally, the abovementioned adapter AP may be attached to the end portion of the side opposite a side of the segmented ink tube 50 on which the coupling 90 is, and the external tank 60 may be connected to the end portion of the abovementioned side that is opposite the side on which the coupling 90 is. In addition, the connection structure of the coupling 90 may be any connection structure such as an interlocking method, a screwing method or the like, for example.

Seventh Different Embodiment

Figure 17:
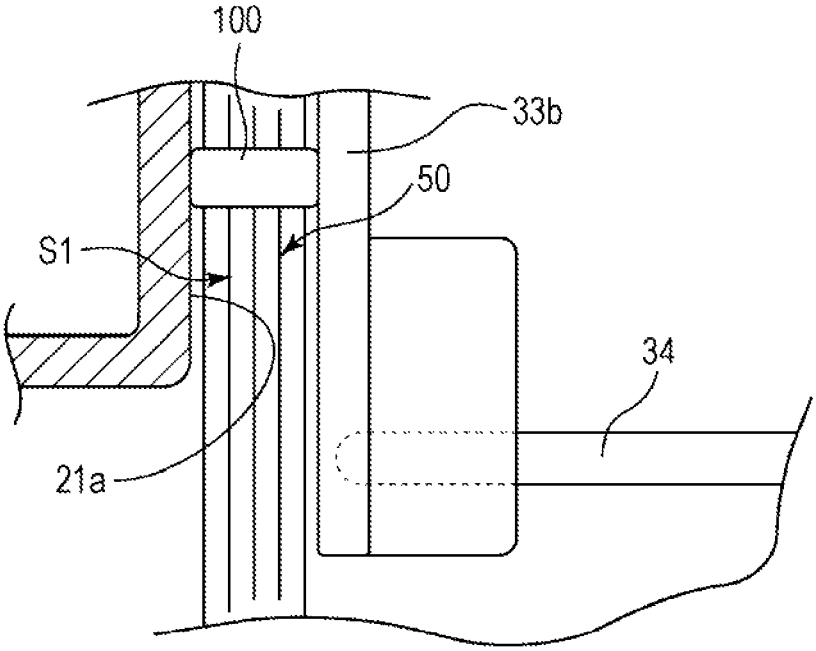
FIG. 17 is view that shows a state in which there is a spacer in the gap section.

In addition, as shown in FIG. 17, a configuration in which a spacer 100 is provided between the movable guide member 33*b* and the inner wall portion 21*a* that faces the movable guide member 33*b* may be used. That is, in a case in which there is a concern that the gap section S1 will become narrow or the ink tube 50 will become crushed by the sliding of the movable guide member 33*b*, a spacer 100 such as that shown in FIG. 17 is provided. As a result of this, it is possible to prevent a situation in which the ink tube 50 is crushed.

Eighth Different Embodiment

Figure 18:
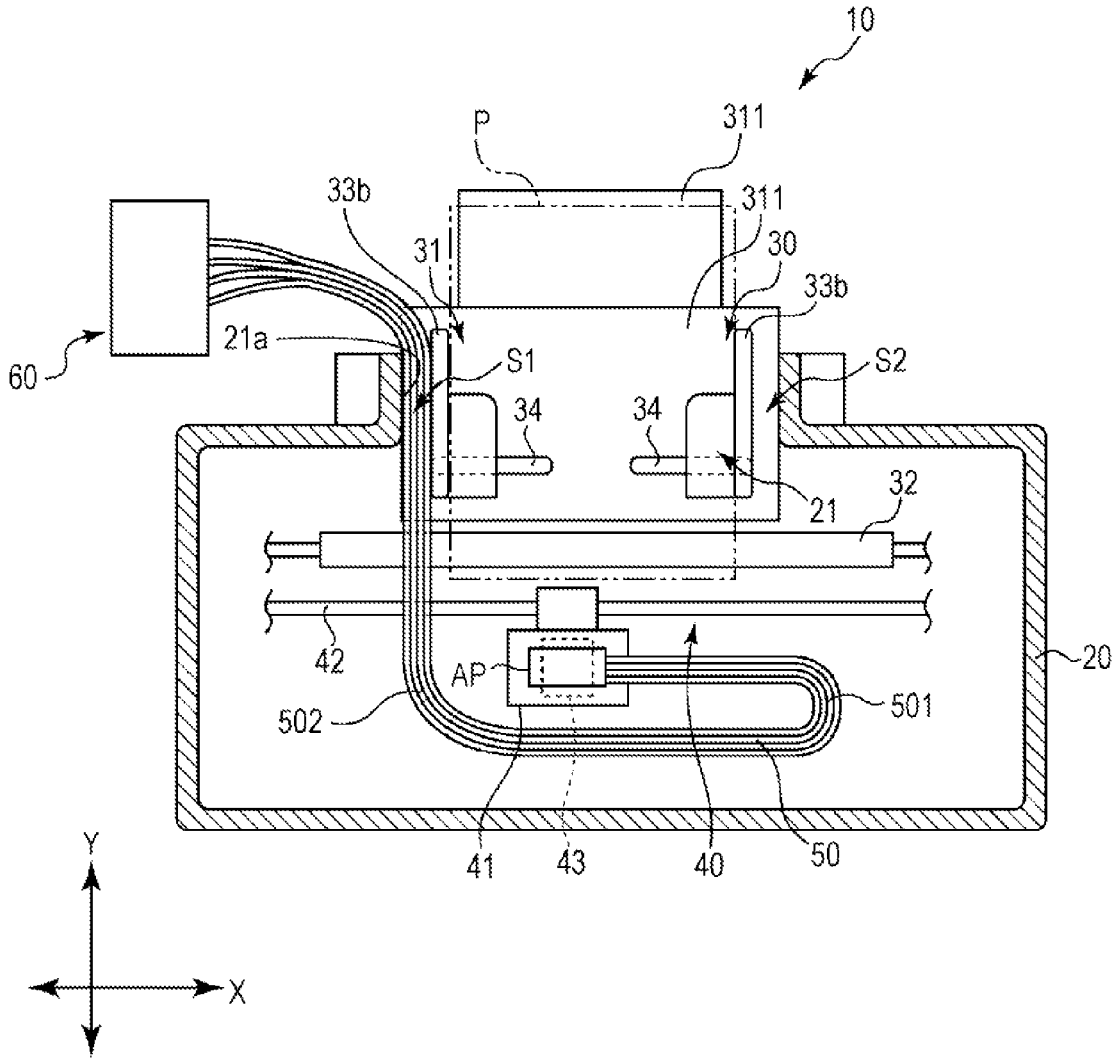
FIG. 18 is a view that shows a configuration in which both guide members in a pair of guide members are movable guide members.

In addition, as shown in FIG. 18, there are cases in which a pair of guide members 33 are movable guide members 33*b*. In a case in which guiding of the recording paper P is performed using a pair of movable guide members 33*b*, the movable guide members 33*b* both move so as to be symmetrical in the main scanning direction (the X direction), and as a result of this, recording paper P reaches a state in which the direction thereof is aligned by the centre of the placement surface of the paper supply tray 31 (so-called centre matching). In this kind of configuration, there are the two gap sections S1 shown in FIG. 1, but the ink tube 50 may be led out to the outside by passing at least one of these gap sections S1.

The abovementioned description is an outline of the present invention, but in cases in which the configurations related to the abovementioned FIGS. 1 to 18 can be combined, it is possible to configure a combined configuration as appropriate. For example, at least one of the disposition embodiment of the ink tube 50 in FIG. 3, the disposition embodiment of the ink tube 50 in FIG. 4, the embodiment of the ink tube 50 being hooked onto the protrusion 331 in FIG. 7, the embodiment of the ink tube 50 not being hooked onto the protrusion 331 in FIG. 8, the leading out of the ink tube 50 from the notched portion S3 in FIG. 9, the fixing member 55 in FIG. 12, the boss 24 in FIG. 13, the fixing member 82 in FIG. 14, the fixing member 83 in FIG. 15, the coupling 90 in FIG. 16 and the spacer 100 in FIG. 17 may be applied to the configurations related to the leading out of the ink tube 50 in FIG. 1, FIG. 2, FIG. 5, FIG. 6, FIG. 10, FIG. 11 or FIG. 16.

2. Specific Configuration of Recording Apparatus 10

Hereinafter, the specific configuration of the recording apparatus 10 will be described on the basis of FIG. 19 to FIG. 22. Additionally, a case in which the ink tube 50 passes a gap section S1 that is between the movable guide member 33*b* and the inner wall portion 21*a* and is led to the outside of the housing 20 in the manner already described on the basis of FIG. 1 and FIG. 2 will be described below.

However, naturally, the configuration related to the leading out of the ink tube 50 can be configured to be a configuration other than those of FIG. 1 and FIG. 2. In other words, in the recording apparatus 10 in FIG. 19 to FIG. 22, by adding changes as appropriate, it is possible to apply configurations related to the leading out of the ink tube 50 in FIG. 1, FIG. 2, FIG. 5, FIG. 6, FIG. 10, FIG. 11 or FIG. 18, and at such a time, at least one of the disposition embodiment of the ink tube 50 in FIG. 3, the disposition embodiment of the ink tube 50 in FIG. 4, the fixing member 55 in FIG. 12, the boss 24 in FIG. 13, the fixing member 82 in FIG. 14, the fixing member 83 in FIG. 15, the coupling 90 in FIG. 16 and the spacer 100 in FIG. 17 may be applied.

(2-1) Recording Apparatus 10 Provided with Scanning Unit 12

Figure 19:
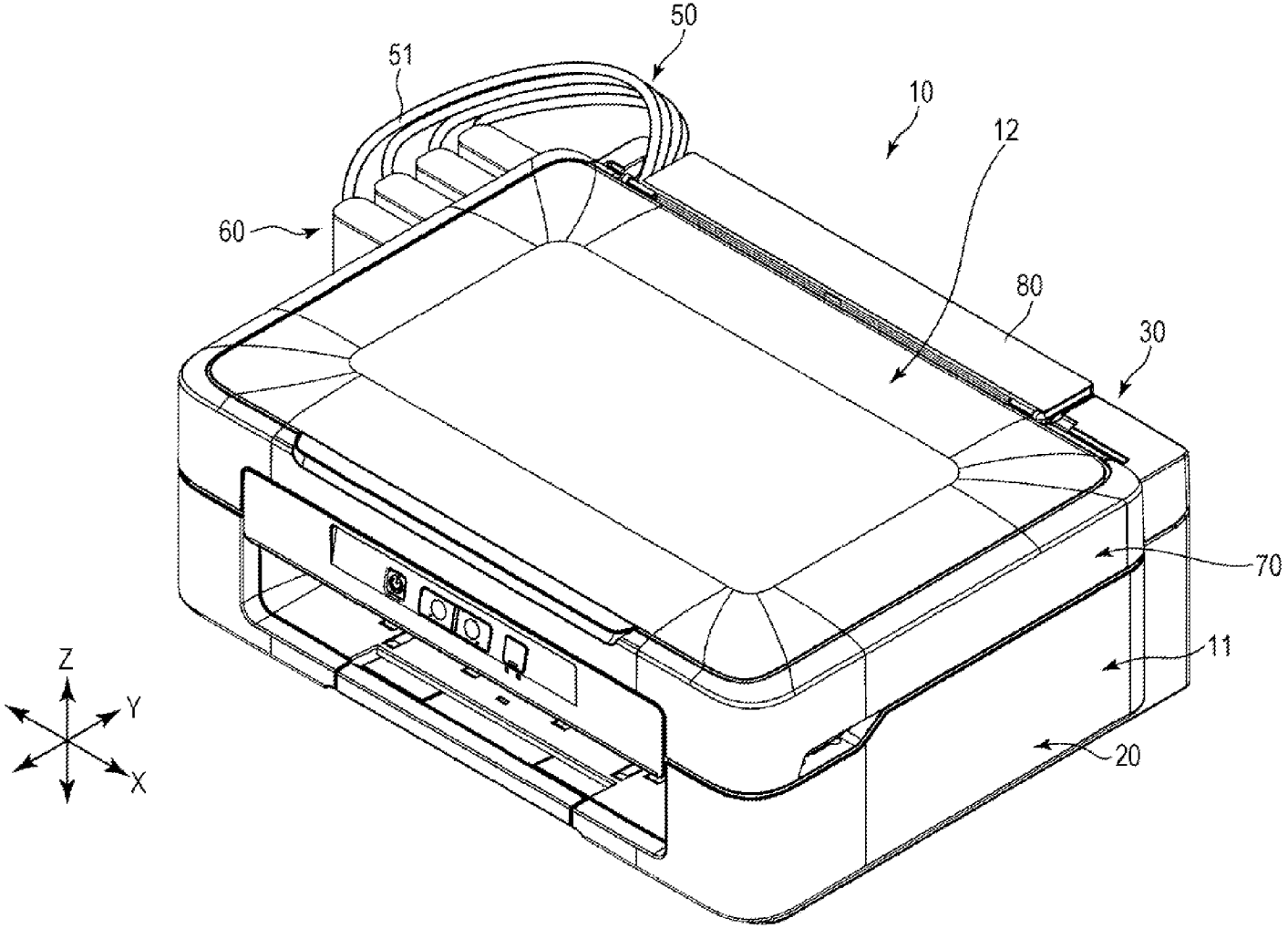
FIG. 19 is a perspective view that shows a configuration of a recording apparatus that is provided with a scanning unit.
Figure 20:
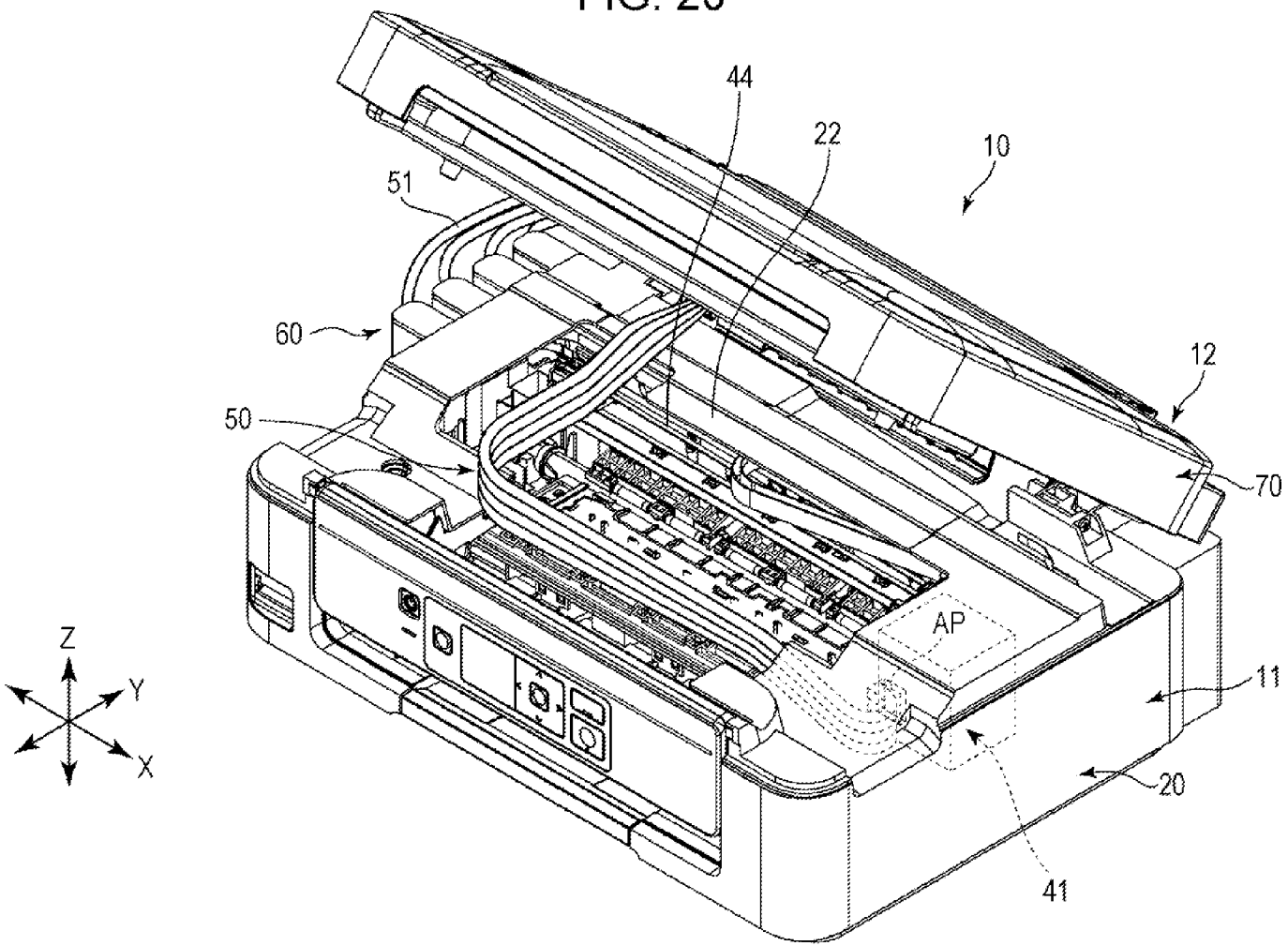
FIG. 20 is a perspective view that shows a configuration of a recording apparatus in a state in which the scanning unit is open.

FIG. 19 is a perspective view that shows a configuration of a recording apparatus 10 that is provided with a scanning unit 12. In addition, FIG. 20 is a perspective view that shows a configuration of a state in which the scanning unit 12 is open. This recording apparatus 10 is provided with a printing unit 11, a scanning unit 12 (corresponding to the opening and closing cover) and a control portion (omitted from the drawing) that manages the control of each driving location. The printing unit 11 is a section that has a configuration that is related to the abovementioned recording apparatuses 10 in FIG. 1, FIG. 2 and the like, and is provided with a housing 20, a paper supply device 30, a carriage mechanism 40 and an ink tube 50. The housing 20 is a section that covers the inside of the recording apparatus 10, and is provided with a top panel 22 as shown in FIG. 20. Further, after the ink tube 50 has passed through the top panel 22, the ink tube 50 has a configuration of being led to the gap section S1.

Figure 21:
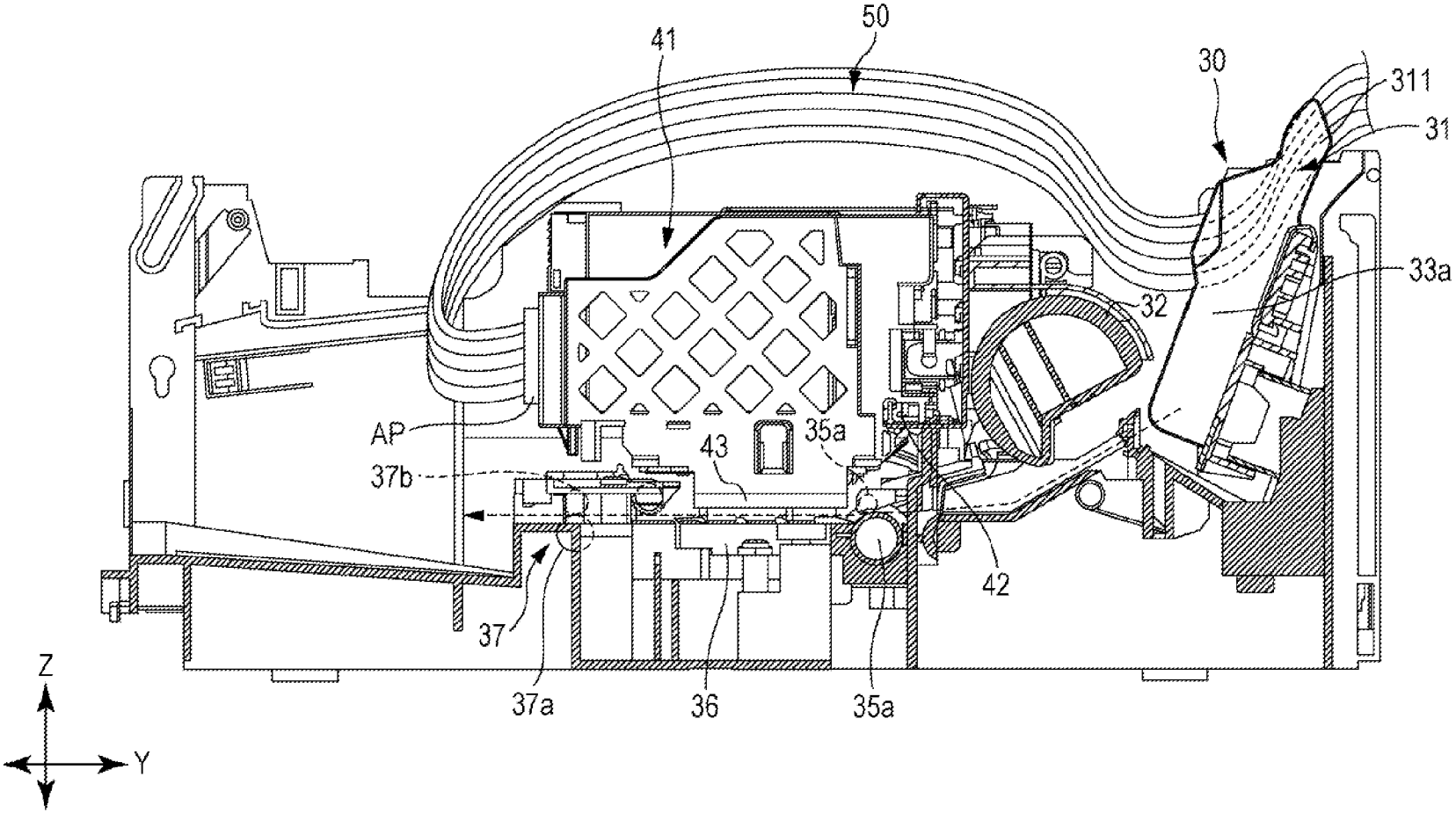
FIG. 21 is a lateral view that shows a recording apparatus in a state in which the scanning unit has been removed.

FIG. 21 is a lateral view of the recording apparatus 10, and is a view that shows a configuration in a state in which the scanning unit 12 has been removed. As shown in FIG. 21, the paper supply tray 31 that forms a component of the paper supply device 30 is provided on the back surface side of the recording apparatus 10. The paper supply tray 31 is configured such that a plurality (for example, 2, 3 or the like) of tray members 311 can be drawn out therefrom, and it is possible to support the recording paper P on the paper supply tray 31 by drawing out the tray members 311. In addition, as shown in FIG. 19, a foreign matter receiving member 80 is provided in the recording apparatus 10 in close proximity to the paper supply tray 31 (omitted from FIG. 19; refer to FIG. 14). In FIG. 19, in addition to the tray members 311 being stowed, the foreign matter receiving member 80 is positioned so as to make an aperture section for paper supply, which includes the abovementioned aperture portion 21, narrow (including a case in which the foregoing is blocked). Additionally, the foreign matter receiving member 80 is provided so as to be capable of rotating on an axis portion of both end sides of the main scanning direction (the X direction), and as a result of this, the foreign matter receiving member 80 can be switched between a case of being positioned in a position that narrows the aperture section in the abovementioned manner and a case of being positioned in a position that opens the aperture section.

In addition, as shown in FIG. 21, the paper supply device has an isolation roller 32 for supplying recording paper from the paper supply tray 31 (the tray members 311). The isolation roller 32 feeds the topmost recording paper P with which the isolation roller 32 is in contact to the downstream side by revolving while maintaining contact with the recording paper P that is in the paper supply tray 31 (tray member 311). Additionally, in the isolation roller 32, drive power is applied by a drive motor (not shown in the drawing) through a drive power transmission means (also not shown in the drawing), and as a result of this, the isolation roller 32 is driven in a revolving manner.

In addition, a paper supply roller 35*a* is provided further to the downstream side in the transport direction (the Y direction) than the isolation roller 32. The paper supply roller 35*a* faces a paper supply driven roller 35*b* and is capable of transporting recording paper P that is supplied from the isolation roller 32 to a facing location of the recording head 43 that is downstream in the transport direction (the Y direction). Drive power is applied to this paper supply roller 35*a* by a supply paper motor (not shown in the drawing). In addition, a platen 36 is provided further to the downstream side in the transport direction (the Y direction) than the paper supply roller 35*a*, and the platen 36 and the recording head 43 are provided so as to be capable of facing one another. In addition, a pair of paper output rollers 37 is provided further to the downstream side in the transport direction (the Y direction) than the platen 36. The pair of paper output rollers 37 is equipped with a paper output drive roller 37*a* and a paper output driven roller 37*b*. The paper output drive roller 37*a* is driven in a revolving manner by a motor (not shown in the drawing). In addition, the paper output driven roller 37*b* is pressed against the paper output drive roller 37*a* by a spring (not shown in the drawing).

In addition, the carriage mechanism 40 is provided with a carriage 41, a carriage axis 42, a recording head 43, a belt 44, a driven pulley 45, a gear pulley (omitted from the drawing) and a carriage motor (also omitted from the drawing). The carriage 41 is provided so that it is possible to attach the abovementioned adapter AP thereto. In addition, as shown in FIG. 21, the recording head 43 that is capable of spraying ink drops is provided on the bottom surface of the carriage 41.

In addition, the belt 44 is an endless belt, and a section thereof is fixed to the back surface of the carriage 41. This belt 44 is stretched in a tense state by the driven pulley 45 and the gear pulley.

In addition, in the configuration shown in FIG. 20 and FIG. 21, the ink tube 50 is attached to the front surface side (the downstream side of the transport direction of the recording paper P) of the carriage 41. However, the ink tube 50 may be attached to the upper surface side of the carriage 41, may be attached to the back surface side of the carriage 41 and may be attached to a side surface side of the carriage 41.

In the configuration shown in FIG. 20 and FIG. 21, the width direction of the ink tube 50 is disposed along a direction that is closer to the vertical direction (the Z direction) than the transport direction (the Y direction). Further, from the attachment position of the ink tube 50 to the carriage 41, the direction of the ink tube 50 is greatly changed so that the direction moves from one end side in the main scanning direction (the X direction) to the other end side with separation from the carriage 41 along the ink tube 50. Thereafter, the position of the ink tube 50 is shifted upward, and after that, the ink tube 50 is bent so as to move toward the back side, led to a gap section after passing through the top panel 22, and led out to the outside of the housing 20 by passing the gap section. Further, the ink tube 50 that has been led out to the outside is separated from a state in which the tube sections 51, inside which inks of the respective ink colors flow, are bundled together, and the tube sections 51 are connected to an external tank 60 in which the respective colors of ink are retained.

Additionally, the width direction of the ink tube 50 may be disposed along a direction that is closer to the transport direction (the Y direction) than the vertical direction (the Z direction).

In addition, the scanning unit 12 is provided so as to capable of opening and closing the printing unit 11 using a hinge section. The scanning unit 12 is equipped with a copy holder (not shown in the drawing), and it is possible to mount a target object for reading on this copy holder. The scanning unit 12 is provided with a scanning carriage which is provided with an image sensor, a carriage drive mechanism, a control portion that manages the control of each driving location and the like (all of which are omitted from the drawing). Further, as a result of the control of the control portion, the image sensor of the scanning carriage is moved relatively with respect to a target object for reading that is mounted on the copy holder by the carriage drive mechanism, and as a result of this, it is possible to read the target object for reading.

In the abovementioned manner, in a recording apparatus 10 such as that shown in FIG. 19 to FIG. 21, a configuration in which it is possible for the ink tube 50 to be led out to the outside of the housing 20 through the gap section S1 in a favorable manner, is used.

(2-2) Recording Apparatus 10 not Provided with Scanning Unit

Figure 22:
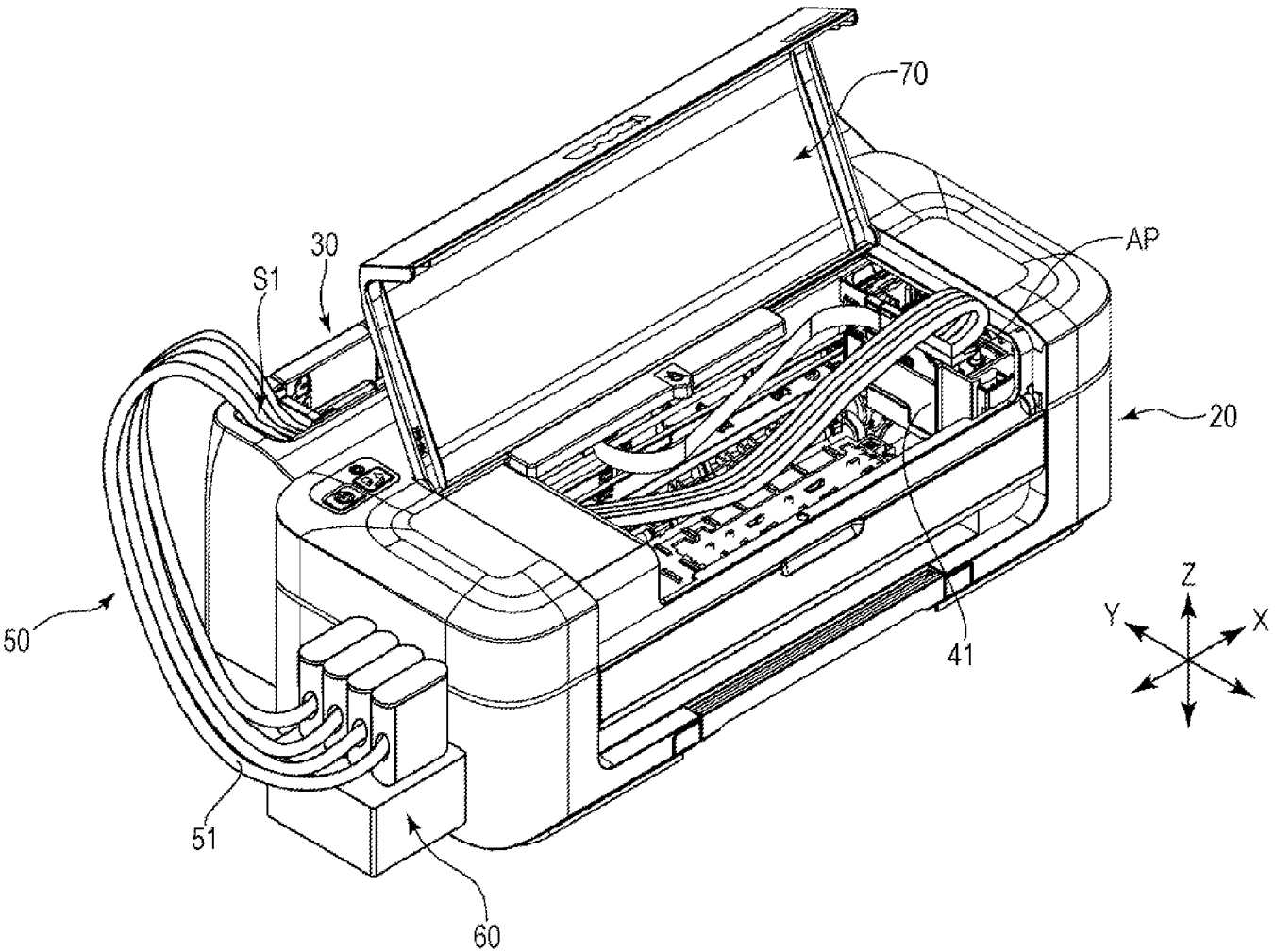
FIG. 22 is a perspective view that shows a configuration of a recording apparatus that is not provided with a scanning unit.

FIG. 22 is a perspective view that shows a configuration of a recording apparatus 10 that is not provided with a scanning unit. This recording apparatus 10 is provided with a configuration that corresponds to the printing unit 11 of the abovementioned recording apparatus 10. Therefore, among the details of each location, the descriptions and display in the drawings of configurations that are common to both recording apparatuses will be omitted.

The recording apparatus 10 shown in FIG. 22 is provided with an opening and closing cover 70, and in a state in which this opening and closing cover 70 is open, it is possible to touch the carriage 41 and the ink tube 50 with one's hand.

In the configuration shown in FIG. 22, the ink tube 50 is attached to the upper surface of the carriage 41. However, the ink tube 50 may be attached to the front surface side (the downstream side of the transport direction of the recording paper P) of the carriage 41, may be attached to the back surface side of the carriage 41 and may be attached to a side surface side of the carriage 41.

The width direction of this ink tube 50 is disposed along a direction (including a case of being almost along the transport direction) that is closer to the transport direction (the Y direction) than the vertical direction. However, the width direction of the ink tube 50 may be disposed along a direction (including a case of being almost along the vertical direction) that is closer to the vertical direction (the Z direction) than the transport direction (the Y direction).

In the configuration shown in FIG. 22, from the attachment position of the ink tube 50 to the carriage 41, the direction of the ink tube 50 is greatly changed so that the direction moves from one end side in the main scanning direction (the X direction) to the other end side with separation from the carriage 41 along the ink tube 50. Thereafter, the position of the ink tube 50 is shifted upward, and after that, the ink tube 50 is bent so as to move toward the back side, led to a gap section S1 after passing through a frame plate 25 that supports the pulleys and the like, and led out to the outside of the housing 20 by passing the gap section S1. Further, the ink tube 50 that has been led out to the outside is separated from a state in which the tube sections 51, inside which inks of the respective ink colors flow, are bundled together, and the tube sections 51 are connected to an external tank 60 in which the respective colors of ink are retained.

In the abovementioned manner, in a recording apparatus 10 such as that shown in FIG. 22, a configuration in which it is possible for the ink tube 50 to be led out to the outside of the housing 20 through the gap section S1 in a favorable manner, is also used.

3. Advantageous Effects

According to the recording apparatuses 10 mentioned above, by passing the ink tube 50 through gap sections S1 and S2 between at least one guide member 33 and inner wall portions 21*a* that face at least one guide member 33, it is possible to lead the ink tube 50 to the outside of the housing 20. Therefore, it is possible for a user to easily put their hand into the recording apparatus 10 or the like from the aperture section 23 that is in the housing 20 when the opening and closing cover 70 is open, and it is possible to easily remove recording paper P that is stuck on the inside of the housing 20. That is, as a result of the application of the present invention, it is possible to improve the maintainability of the recording apparatus 10 without the ink tube 50 becoming an obstruction when removing recording paper P that has become stuck inside the housing 20.

In addition, in the recording apparatus 10 of the present invention, since the ink tube 50 is led to the outside of the housing 20 by passing at least one of the gap sections S1 and S2, it is possible to prevent a situation in which the ink tube 50 becomes crushed or the like by the opening and closing cover 70 or the like.

In addition, in the recording apparatus 10 of the present invention, as shown in FIG. 10 and FIG. 11, it is also possible to configure such that the ink tube 50 passes through both the gap section S1 and the gap section S2. In a case of configuring in this manner, it is also possible to improve the maintainability of the recording apparatus 10 without the ink tube 50 becoming an obstruction when removing recording paper P that has become stuck inside the housing 20. In addition, since the ink tube 50 is led to the outside of the housing 20 by passing both the gap section S1 and the gap section S2, it is possible to prevent a situation in which the ink tube 50 becomes crushed or the like by the opening and closing cover 70 or the like.

Furthermore, as shown in FIG. 14, in the recording apparatus 10 of the present invention, it is also possible to configure such that the foreign matter receiving member 80 and the protrusion 331 are fixed with the fixing member 82 so as to retain a state in which the foreign matter receiving member 80 abuts against the protrusion 331. In a case of configuring in this manner, it is possible to prevent stowing of the tray member 311 in the stowing location, and it is possible to prevent a situation in which the protrusion 331 severs or crushes the ink tube 50 that is positioned in the stowing pathway (the downstream side of the stowing pathway) of the guide member 33 when the tray member 311 is stowed. Additionally, in place of the fixing member 82 shown in FIG. 14, the fixing member 83 such as that shown in FIG. 15 may be used. In a case of configuring in this manner, it is also possible to prevent a situation in which the protrusion 331 severs or crushes the ink tube 50 when the tray member 311 is stowed.

In addition, as shown in FIG. 17, in the recording apparatus 10 of the present invention, it is also possible to configure so as to provide a spacer 100 between the movable guide member 33*b* and the inner wall portion 21*a*. In a case of configuring in this manner, it is even possible to prevent a situation in which the ink tube 50 becomes crushed by the movable guide member 33*b* in a case in which the movable guide member 33*b* is moved toward the inner wall portion 21*a*.

In addition, in the recording apparatus 10 of the present invention, the ink tube 50 passes through the aperture section 23 (refer to FIG. 12) and is positioned on the top panel 22 after jutting out from the inside of the housing 20, and thereafter, the ink tube 50 is configured to be able to pass through the gap sections S1 and S2. In a case of configuring in this manner, since a section of the ink tube 50 is positioned on the top panel 22, the ink tube 50 is supported by the top panel 22. As a result of this, it is possible to prevent the ink tube 50 from reaching a scanning pathway of the carriage 41 and becoming an obstacle to the scanning of the carriage 41.

Furthermore, as shown in FIG. 12, in the recording apparatus 10 of the present invention, it is also possible to configure such that a section of the ink tube 50 is fixed to the top panel 22 by the fixing member 55. In a case of configuring in this manner, it is possible to prevent a situation in which the ink tube 50 is shaken at the time of the scanning of the carriage 41, and it is possible to stabilize the behavior of the ink tube 50 inside the housing 20.

4. Modification Examples

One embodiment of the present invention has been described above, but it is possible to make various modifications to the present invention. Such modification will be described below.

(4-1) First Modification Example

In the abovementioned embodiment, the ink tube 50 is connected to the carriage 41 through an adapter AP. However, it is possible to adopt a configuration in which the ink tube 50 is connected to the carriage 41 without the adapter AP. For example, in a configuration in which a sub tank in which ink is retained, is provided instead of an ink cartridge being mounted on the carriage 41, a configuration in which the ink tube 50 is connected in a state of being capable of conducting ink to the sub tank.

(4-2) Second Modification Example

In addition, in the abovementioned embodiment (this includes the different embodiments and the like and the same applies below), the gap sections S1 and S2 are configured to be between the inner wall portion 21*a* of the aperture portion 21 of the housing 20 and the guide member 33. However, the gap sections S1 and S2 may be configured to be in sections other than these. For example, the paper supply device 30 may be positioned in the aperture portion 21 and the gap sections S1 and S2 may be configured to be between the inner wall portion of the housing section of the paper supply device 30 and the guide member 33. In a case of configuring in this manner, it is also possible to improve the maintainability of the recording apparatus 10 without the ink tube 50 becoming an obstruction when removing recording paper P that has become stuck inside the housing 20. In addition, since the ink tube 50 is led to the outside of the housing 20 by passing both the gap section S1 and the gap section S2, it is possible to prevent a situation in which the ink tube 50 becomes crushed or the like by the opening and closing cover 70 or the like.

(4-3) Third Modification Example

In addition, in the abovementioned embodiment, at least one of the gap section S1 and the gap section S2 is configured to be between the inner wall portion 21*a* of the aperture portion 21 of the housing 20 and the guide member 33. However, at least one of the gap section S1 and the gap section S2 may be between the inner wall portion 21*a* of the aperture portion 21 of the housing 20 and the tray member 311 (in particular, the wall portion that is positioned at the end portion of the tray member 311). That is, regardless of whether or not there is a guide member 33, a section that is between the inner wall portion 21*a* and the tray member 311 may be configured to be the gap sections S1 and S2. In a case of configuring in this manner, it is also possible to lead the ink tube 50 out to the outside of the housing 20 in a favorable manner using at least one of the gap section S1 and the gap section S2. Additionally, in this case, it is particularly preferable to lead the ink tube 50 out to the outside of the housing 20 in a favorable manner using at least one of the abovementioned gap section S1 and the gap section S2 between the tray member 311 that corresponds to a second tray member and the inner wall portion 21*a*.

(4-4) Fourth Modification Example

In addition, in a case (the case of the Third Modification Example) in which the ink tube 50 is led out to the outside of the housing 20 using a gap section (at least one of the gap section S1 and the gap section S2) between the inner wall portion 21*a* of the aperture portion 21 of the housing 20 and the tray member 311 (in particular, a wall portion that is positioned at the end portion of the tray member 311) in the manner described above, a wall portion of the tray member 311 may be configured to function as a guide member 33.

(4-5) Fifth Modification Example

In addition, in the abovementioned embodiment, as shown in FIG. 7, the ink tube 50 is in a state of being hooked onto the protrusion 331, and after the hooking (abutting) onto the protrusion 331, the ink tube 50 extends toward the external tank 60. However, the following configuration may be used. That is, in the cases of the Third Modification Example and the Fourth Modification Example, the protrusion 331 is provided in wall portion side of the tray member 311. Further, in a case in which the ink tube 50 is led out to the outside of the housing 20 using a gap section (at least one of the gap section S1 and the gap section S2) between the inner wall portion 21*a* of the aperture portion 21 of the housing 20 and the tray member 311 (in particular, a wall portion that is positioned at the end portion of the tray member 311), the ink tube 50 may be configured to hook onto the abovementioned protrusion 331, and extend toward the external tank 60 after the hooking (abutting) onto the protrusion 331. In this case, a configuration in which there is a protrusion 331 even if there is not a guide member 33 on the tray member 311 is used (naturally, it is also possible for there to be a guide member 33 on the tray member 311), but in this kind of configuration, it is also possible to use the protrusion 331 for the positioning of the ink tube 50. In addition, it is possible to change the direction in which the ink tube 50 is drawn out using the protrusion 331.

(4-6) Sixth Modification Example

Additionally, in the respective cases of the abovementioned Third Modification Example to Fifth Modification Example, a foreign matter receiving member 80 such as that shown in FIG. 14 may be provided. In this case, a configuration in which the foreign matter receiving member 80 is in a state of being received by the protrusion 331 and the foreign matter receiving member 80 and the protrusion 331 are fixed with the fixing member 82 may be used. By configuring in this manner, in a case in which the ink tube 50 is led out to the outside of the housing 20 using a gap section (at least one of the gap section S1 and the gap section S2) between the inner wall portion 21*a* of the aperture portion 21 of the housing 20 and the tray member 311 (in particular, a wall portion that is positioned at the end portion of the tray member 311), it is even possible to prevent a situation in which the ink tube 50 is severed or crushed by the protrusion 331 in a case in which the tray member 311 is stowed.

(4-7) Seventh Modification Example

Additionally, in the respective cases from the abovementioned Third Modification Example to the Sixth Modification Example, a guide member 33 may be provided in the tray member 311 (in particular, a tray member 311 that corresponds to the second tray member). In particular, a configuration in which a guide member 33 faces the inner wall portion 21*a* of the housing 20, and the width of the recording paper P is defined by the guide member 33, may be used. In this case, either a fixed guide member 33*a* or a movable guide member 33*b* may be provided in the tray member 311, but it is also possible to provide both (that is, a pair of guide members 33) a fixed guide member 33*a* and a movable guide member 33*b* in the tray member 311. Further, the width of both ends of the recording paper P may be defined by the pair of guide members 33.

(4-8) Eighth Modification Example

In addition, in the respective cases of the abovementioned Seventh Modification Example, a spacer 100 such as that shown in FIG. 17 may be provided in the gap section S1. That is, in a case in which the gap section S1 is between the inner wall portion 21*a* of the aperture portion 21 of the housing 20 and the tray member 311 (in particular, a wall portion that is positioned at the end portion of the tray member 311), and there is a movable guide member 33*b* in the tray member 311 (in particular, a tray member 311 that corresponds to the second tray member), a spacer 100 such as that shown in FIG. 17 may be provided in the gap section S1. As a result of this, it is even possible to prevent a situation in which the ink tube 50 becomes crushed in a case in which there is a concern that the gap section S1 will become narrow or the ink tube 50 will become crushed by the sliding of the movable guide member 33.

(4-9) Ninth Modification Example

In addition, in the abovementioned embodiment, the recording head 43 is attached to the carriage 41, and moves along the main scanning direction of the recording head 43 together with movement in the main scanning direction of the carriage 41. However, the recording head 43 may for example, be a line head that is provided longitudinally along the width direction of the recording paper P. Even in a case of a line head, it is possible to improve the maintainability of the recording apparatus 10 without the ink tube 50 becoming an obstruction when removing recording paper P that has become stuck inside the housing 20 in the same manner as that of the abovementioned embodiment. In addition, since the ink tube 50 is led to the outside of the housing 20 by passing both the gap section S1 and the gap section S2, it is possible to prevent a situation in which the ink tube 50 becomes crushed or the like by the opening and closing cover 70 or the like.

(4-10) Tenth Modification Example

In addition, in the drawings in the abovementioned embodiment, the ink tube 50 is shown as an ink tube that has four tube sections 51, and the four tube sections 51 correspond to the four colors of cyan, magenta, yellow and black. However, the number of tube sections 51 in the ink tube 50 is not limited to four, and there may be any number of tube sections 51 provided there are three or more (in a case in which there are three tube sections 51, the three tube sections 51 correspond to the three colors of cyan magenta and yellow). In addition, a configuration which provides tube sections 51 for supplying for example, light cyan, light magenta, light yellow, light grey and the like is also possible.

Additionally, it is preferable that one tube section 51 corresponds to one color of ink, but two or more tube sections 51 which are provided in parallel, may correspond to one color, and a certain color of ink may be supplied using the two or more tube sections 51 simultaneously.

(4-11) Eleventh Modification Example

In addition, in the abovementioned embodiment, it is also possible to include a fluid spraying apparatus that sprays liquid other than ink (including liquid itself, a liquid body in which particles of a functional material are dispersed in or mixed into a liquid or a substance that has a fluid property such as gel) in the concept of the recording apparatus 10. Examples of such apparatuses include a liquid body spraying apparatus that sprays a liquid that includes materials such as electrode materials, color materials (pixel materials) and the like, which are used in the production of liquid crystal displays, EL (electroluminescent) displays and surface light emission displays, in a dispersed or dissolved form, a fluid spraying apparatus that sprays living organic matter that is used in the production of biochips, a fluid spraying apparatus that is used as a precision pipette and sprays a liquid that will form a specimen and the like.

(4-12) Twelfth Modification Example

Furthermore, examples of apparatuses that are included in the concept of the recording apparatus 10 of the present invention include a fluid spraying apparatus that sprays lubricating oil onto precision instruments such as clocks and cameras in a pinpoint manner, a fluid spraying apparatus that sprays transparent resin liquid such as ultraviolet curable resin for forming hemispherical microlenses (optical lenses), which are used in optical communication elements and the like, onto a substrate, a fluid spraying apparatus that sprays an etching liquid such as an acid or an alkali for etching of a substrate or the like, a fluid body spraying apparatus that sprays a fluid body such as gel (for example, physical gel) and the like.

REFERENCE SIGNS LIST

10: recording apparatus
11: printing unit
12: scanning unit (corresponds to an example of the opening and closing cover)

20: housing
21: aperture portion
21*a*: inner wall portion (corresponds to an example of the wall surface portion)
22: top panel
23: aperture section
24: boss
25: frame plate
30: paper supply device
31: paper supply tray
32: isolation roller
33: guide member
33*a*: fixed guide member
33*b*: movable guide member
34: guide groove
35*a*: paper supply roller
35*b*: paper supply driven roller
36: platen
37: pair of paper output rollers
37*a*: paper output drive roller
37*b*: paper output driven roller
40: carriage mechanism
41: carriage
42: carriage axis
43: recording head
44: belt
45: driven pulley
50: ink tube
50*a*: unbranched tube
50*b*: first branched tube
50*c*: second branched tube
51: tube sections
52: branched portion
53: curving section
54: unbranched turning portion
55: fixing member
60: external tank
70: opening and closing cover
80: foreign matter receiving member
82: fixing member
83: fixing member
90: coupling
100: spacer
311: tray member
331: protrusion
501: curved portion
502: turning portion
AP: adapter
P: recording paper (corresponds to an example of the recording medium)
S1 and S2: gap sections The entire disclosure of Japanese Patent Application No. 2012-074291 filed on Mar. 28, 2012, is expressly incorporated by reference herein.

The invention claimed is:

1. A recording apparatus comprising:

a paper supply tray that is provided on an upstream side of a transport direction in which a recording medium is transported, and which can feed the recording medium from a first aperture portion provided in a housing;

a guide member, which is provided in the paper supply tray and defines a width of the recording medium; and an ink tube that passes through gap sections between the guide member and the housing and supplies ink from an ink accommodation portion which is provided outside the housing to a recording head that is attached to a carriage.

2. The recording apparatus according to claim 1, wherein the guide member is provided in a pair and the pair of guide members can define the width at both ends of the recording medium, gap sections are respectively provided between the pair of guide members and the housing, and the ink tube respectively passes through the gap sections.

3. The recording apparatus according to claim 1, wherein a foreign matter receiving member, which prevents the intrusion of foreign matter from the first aperture portion, is attached to the housing, the foreign matter receiving member is positioned in a state of facing the paper supply tray, and an abutting portion that abuts against the foreign matter receiving member is provided in the paper supply tray and the foreign matter receiving member and the abutting portion are fixed to one another.

4. The recording apparatus according to claim 2, wherein a foreign matter receiving member, which prevents the intrusion of foreign matter from the first aperture portion, is attached to the housing, the foreign matter receiving member is positioned in a state of facing the paper supply tray, and an abutting portion that abuts against the foreign matter receiving member is provided in the paper supply tray and the foreign matter receiving member and the abutting portion are fixed to one another.

5. The recording apparatus according to claim 2, wherein one of the guide members among the pair of guide members is a movable guide member that is provided so as to be capable of sliding along the width direction of the paper supply tray, and a spacer is provided between the movable guide member and the housing to correspond to the passing through of the ink tube.

6. The recording apparatus according to claim 4, wherein one of the guide members among the pair of guide members is a movable guide member that is provided so as to be capable of sliding along the width direction of the paper supply tray, and a spacer is provided between the movable guide member and the housing to correspond to the passing through of the ink tube.

7. The recording apparatus according to claim 1, wherein, in the housing, a second aperture portion is provided further on a side which is opposite a side on which the carriage is clamped than a location in which the recording medium is positioned and at which recording is performed by the recording head, an opening and closing cover is provided in the housing so as to be capable of rotating and the second aperture portion is opened and closed by rotation of the opening and closing cover, and the ink tube, which extends from an attachment position to the carriage, passes through the second aperture portion from the carriage side and is provided in a state of passing through the gap sections.

8. The recording apparatus according to claim 2, wherein, in the housing, a second aperture portion is provided further on a side which is opposite a side on which the carriage is clamped than a location in which the recording medium is positioned and at which recording is performed by the recording head, an opening and closing cover is provided in the housing so as to be capable of rotating and the second aperture portion is opened and closed by rotation of the opening and closing cover, and the ink tube, which extends from an attachment position to the carriage, passes through the second aperture portion from the carriage side and is provided in a state of passing through the gap sections.

9. The recording apparatus according to claim 3, wherein, in the housing, a second aperture portion is provided further on a side which is opposite a side on which the carriage is clamped than a location in which the recording medium is positioned and at which recording is performed by the recording head, an opening and closing cover is provided in the housing so as to be capable of rotating and the second aperture portion is opened and closed by rotation of the opening and closing cover, and the ink tube, which extends from an attachment position to the carriage, passes through the second aperture portion from the carriage side and is provided in a state of passing through the gap sections.

10. The recording apparatus according to claim 4, wherein, in the housing, a second aperture portion is provided further on a side which is opposite a side on which the carriage is clamped than a location in which the recording medium is positioned and at which recording is performed by the recording head, an opening and closing cover is provided in the housing so as to be capable of rotating and the second aperture portion is opened and closed by rotation of the opening and closing cover, and the ink tube, which extends from an attachment position to the carriage, passes through the second aperture portion from the carriage side and is provided in a state of passing through the gap sections.

11. The recording apparatus according to claim 5, wherein, in the housing, a second aperture portion is provided further on a side which is opposite a side on which the carriage is clamped than a location in which the recording medium is positioned and at which recording is performed by the recording head, an opening and closing cover is provided in the housing so as to be capable of rotating and the second aperture portion is opened and closed by rotation of the opening and closing cover, and the ink tube, which extends from an attachment position to the carriage, passes through the second aperture portion from the carriage side and is provided in a state of passing through the gap sections.

12. The recording apparatus according to claim 6, wherein, in the housing, a second aperture portion is provided further on a side which is opposite a side on which the carriage is clamped than a location in which the recording medium is positioned and at which recording is performed by the recording head, an opening and closing cover is provided in the housing so as to be capable of rotating and the second aperture portion is opened and closed by rotation of the opening and closing cover, and the ink tube, which extends from an attachment position to the carriage, passes through the second aperture portion from the carriage side and is provided in a state of passing through the gap sections.

13. The recording apparatus according to any one of claims 7 to 12, wherein a top panel is provided in the housing on a side that runs from the second aperture portion to the paper supply tray, and the ink tube is fixed to the top panel.

14. A recording apparatus comprising:

a paper supply tray that is provided on an upstream side of a transport direction in which a recording medium is transported, which can feed the recording medium from a first aperture portion provided in a housing, and has a first tray member and a second tray member that can extend from the first tray member; and an ink tube that passes through gap sections between a wall portion of the second tray member and the housing and supplies ink from an ink accommodation portion which is provided outside the housing to a recording head that is attached to a carriage.

15. The recording apparatus according to claim 14, wherein the wall portion functions as a guide member that defines the width of the recording medium.

16. The recording apparatus according to claim 14, wherein a protrusion that protrudes from a placement surface of the second tray member where the recording medium is placed toward a side separated therefrom is provided on a side of the wall portion of the second tray member, and the ink tube is positioned in a state of being hooked onto the protrusion.

17. The recording apparatus according to claim 15, wherein a protrusion that protrudes from a placement surface of the second tray member where the recording medium is placed toward a side separated therefrom is provided on a side of the wall portion of the second tray member, and the ink tube is positioned in a state of being hooked onto the protrusion.

18. The recording apparatus according to claim 16, wherein a foreign matter receiving member, which prevents the intrusion of foreign matter from the first aperture portion, is attached to the housing, and the foreign matter receiving member is provided in a position that faces the paper supply tray.

19. The recording apparatus according to claim 17, wherein a foreign matter receiving member, which prevents the intrusion of foreign matter from the first aperture portion, is attached to the housing, and the foreign matter receiving member is provided in a position that faces the paper supply tray.

20. The recording apparatus according to claim 18, wherein the foreign matter receiving member and the protrusion are fixed to one another.

21. The recording apparatus according to claim 19, wherein the foreign matter receiving member and the protrusion are fixed to one another.

22. The recording apparatus according to claim 14, wherein a guide member that defines the width of the recording medium is provided in the second tray member.

23. The recording apparatus according to claim 16, wherein a guide member that defines the width of the recording medium is provided in the second tray member.

24. The recording apparatus according to claim 18, wherein a guide member that defines the width of the recording medium is provided in the second tray member.

25. The recording apparatus according to claim 20, wherein a guide member that defines the width of the recording medium is provided in the second tray member.

26. The recording apparatus according to any one of claims 22 to 25, wherein the guide member is provided in a pair and the pair of guide members can define the width at both ends of the recording medium.

27. The recording apparatus according to claim 26, wherein one of the guide members among the pair of guide members is a movable guide member that is provided so as to be capable of sliding along the width direction of the second tray member.

28. The recording apparatus according to claim 27, wherein a spacer is provided between the movable guide member and the housing to correspond to the passing through of the ink tube.

* * * * *